US012791206B2

(12) United States Patent
Caplow, Jr. et al.

(10) Patent No.: US 12,791,206 B2
(45) Date of Patent: Nov. 10, 2026

(54) RADIATIVE COOLING DEVICE

(71) Applicant: Caplow Tech, LLC, Miami, FL (US)

(72) Inventors: Theodore Caplow, Jr., Miami, FL (US); Chase Fernando Camarotti, Miami, FL (US)

(73) Assignee: Caplow Tech, LLC, Miami, FL (US)

( * ) Notice: Subject to any disclaimer, the term of this patent is extended or adjusted under 35 U.S.C. 154(b) by 0 days.

(21) Appl. No.: 18/229,168

(22) Filed: Aug. 1, 2023

(65) Prior Publication Data

US 2025/0043973 A1 Feb. 6, 2025

(51) Int. Cl.

| | |
|---|---|
| ***F24F 5/00*** | (2006.01) |
| ***F24F 1/022*** | (2019.01) |
| ***F24F 1/0323*** | (2019.01) |
| ***F24F 13/22*** | (2006.01) |

(52) U.S. Cl.

CPC ..... *F24F 5/0089* (2013.01); *F24F 1/022* (2013.01); *F24F 1/0323* (2019.02); *F24F 13/222* (2013.01)

(58) Field of Classification Search

CPC ..... F24F 5/0089; F24F 1/0323; F24F 1/022; F24F 1/028; F24F 13/222; F24F 13/28; F24F 13/085; F24F 2013/228

See application file for complete search history.

(56) References Cited

U.S. PATENT DOCUMENTS 2,811,842 A * 11/1957 Taylor ..... F24F 1/022 62/286
3,905,203 A * 9/1975 Jacob ..... F24F 13/22 62/93
5,392,944 A * 2/1995 Jennings ..... F24F 13/222 220/571
5,729,994 A 3/1998 Mukaiyama et al.
6,280,320 B1 8/2001 Paschke et al.

(Continued)

FOREIGN PATENT DOCUMENTS

CN 209588186 U 5/2019
CN 213713526 U 7/2021

(Continued)

OTHER PUBLICATIONS

English Translation of JP-2005296155. McElroy Translation Company, Apr. 2014.*

(Continued)

*Primary Examiner* — Tavia Sullens
(74) *Attorney, Agent, or Firm* — Bryan Wilson IP Law, PLLC

(57) ABSTRACT

Provided is a dry surface radiative cooling device, including: at least one ambient air inlet; a housing comprising at least one cooled air outlet; a permeable member connected to the housing and comprising a permeable surface disposed at least partially adjacent to the at least one cooled air outlet; a refrigerant circuit disposed at least partially within the housing and comprising a first heat exchanger, wherein the first heat exchanger is separated from the permeable member by a gap; and a first air flow path disposed at least partially within the housing, extending between the at least one ambient air inlet and the at least one cooled air outlet and through the permeable surface, and at least partially defined by the gap between the surface of the first heat exchanger and the permeable member.

25 Claims, 20 Drawing Sheets

(56) References Cited

U.S. PATENT DOCUMENTS

| | | | | |
|---|---|---|---|---|
| 6,358,139 | B1 * | 3/2002 | Renz | F24F 13/24 55/385.2 |
| 6,425,417 | B1 | 7/2002 | Paschke | |
| 6,558,250 | B1 | 5/2003 | Paschke | |
| 6,823,678 | B1 | 11/2004 | Li | |
| 6,953,396 | B2 | 10/2005 | Paschke et al. | |
| 6,958,011 | B2 | 10/2005 | Gebke | |
| 6,960,130 | B2 | 11/2005 | Gebke et al. | |
| 7,188,480 | B2 | 3/2007 | Korin | |
| 8,202,620 | B2 * | 6/2012 | Simon | C08F 290/062 427/407.1 |
| 8,434,526 | B1 | 5/2013 | Pinkalla et al. | |
| 8,676,545 | B2 | 3/2014 | Kaufmann et al. | |
| 8,808,075 | B2 | 8/2014 | Gebke et al. | |
| 8,844,578 | B2 | 9/2014 | Pinkalla et al. | |
| 9,039,503 | B2 | 5/2015 | Gebke et al. | |
| 9,303,892 | B2 | 4/2016 | Heim et al. | |
| 9,494,336 | B2 | 11/2016 | Pinkalla et al. | |
| 9,518,756 | B2 | 12/2016 | Brown et al. | |
| 9,605,864 | B2 | 3/2017 | Pinkalla et al. | |
| 9,605,865 | B2 | 3/2017 | Pinkalla et al. | |
| 9,612,033 | B2 | 4/2017 | Pinkalla et al. | |
| 9,644,858 | B2 | 5/2017 | Pinkalla et al. | |
| 9,709,193 | B2 | 7/2017 | Gebke et al. | |
| 9,732,790 | B2 | 8/2017 | Trevelyn | |
| 9,784,469 | B2 | 10/2017 | Ramos et al. | |
| 9,890,976 | B2 | 2/2018 | Tamura et al. | |
| 9,901,011 | B2 | 2/2018 | Heim et al. | |
| 9,927,139 | B2 | 3/2018 | Pinkalla et al. | |
| 9,927,140 | B2 | 3/2018 | Pinkalla et al. | |
| 10,066,850 | B2 | 9/2018 | Pinkalla et al. | |
| 10,208,981 | B2 | 2/2019 | Pinkalla et al. | |
| 10,251,312 | B2 | 4/2019 | Sloan et al. | |
| 10,401,041 | B2 | 9/2019 | Galvan | |
| 10,480,813 | B2 | 11/2019 | Pinkalla et al. | |
| 10,709,040 | B2 | 7/2020 | Heim | |
| 10,876,758 | B2 | 12/2020 | Pinkalla et al. | |
| 11,137,164 | B2 | 10/2021 | Lu et al. | |
| 2010/0263829 | A1 * | 10/2010 | Kimura | F24F 5/0089 165/104.34 |
| 2011/0252813 | A1 * | 10/2011 | Veltrop | F25B 21/02 62/255 |
| 2012/0171946 | A1 | 7/2012 | Nagtegaal et al. | |
| 2015/0068609 | A1 | 3/2015 | Aramli | |
| 2015/0354874 | A1 * | 12/2015 | Cur | F24F 13/28 29/890.035 |
| 2017/0167749 | A1 * | 6/2017 | Murakami | F24F 5/0089 |
| 2017/0314837 | A1 | 11/2017 | Alsadah et al. | |
| 2018/0274798 | A1 * | 9/2018 | Jung | F24F 1/0014 |
| 2019/0154283 | A1 | 5/2019 | Dempsey et al. | |
| 2019/0212032 | A1 * | 7/2019 | Martinez Galvan | F24F 1/022 |
| 2019/0285287 | A1 * | 9/2019 | Kimura | F24F 5/0089 |
| 2020/0214459 | A1 | 7/2020 | Venditto et al. | |
| 2020/0318837 | A1 | 10/2020 | Selg et al. | |

FOREIGN PATENT DOCUMENTS

| | | | | |
|---|---|---|---|---|
| CN | 115264677 | A | 11/2022 | |
| DE | 3739619 | A1 * | 4/1988 | F28F 13/12 |
| JP | 2005296155 | A * | 10/2005 | |

OTHER PUBLICATIONS

Collins Dictionaries (Ed.). (2014). Heat exchanger. In Collins English Dictionary (12th ed.). Collins. https://search.credoreference.com/articles/Qm9va0FydGljbGU6MzU5MTE1Nw==?aid=279753.*

Anthony Usibelli et al, "Commercial-Sector Conservation Technologies" Lawrence Berkeley National Laboratory. LBNL Report #: LBL-18543, Feb. 1, 1985.

Corina Stetiu, "Radiant cooling in U.S. Office buildings: Towards eliminating the perception of climate-imposed barriers", Lawrence Berkeley National Laboratory. LBNL Report #: LBNL-41275, Jan. 1, 1998.

Kurt Roth, et al., "Energy Consumption Characteristics of Commercial Building HVAC Systems—vol. III: Energy Saving Potential", DOE Building Technologies Program TIAX Reference No. 68370-00, Aug. 3, 2023.

Eric Teitelbaum, et al., Membrane-assisted radiant cooling for expanding thermal comfort zones globally without air conditioning:, PNAS, Jul. 20, 2020.

William Goetzler, et al., "Energy Savings Potential and RD&D Opportunities for Non Vapor-Compression HVAC Technologies", DOE Building Technologies Office Mar. 1, 2014.

Amo Schlueter, et al., "3for2 Realizing Spatial Material and Energy Savings through Integrated Design" CTBUH Journal 2016.

Shaimaa Seyam, "Energy and Exergy Analysis of Refrigeration Systems" Low Temperature Technologies Nov. 12, 2019.

Arlan Burdick, "Strategy Guideline: Accurate Heating and Cooling Load Calculations", DOE Building Technologies Program NREL/SR-5500-51603 Jun. 1, 2011.

Parker Hannifin Corporation, Sporlan Division, "Thermostatic Expansion Valves Theory of Operation, Application, and Selection" Bulletin 10-9 Mar. 1, 2011.

Parker Hannifin Corporation, Sporlan Division, "Refrigerant Distributors" Bulletin 20-10 Feb. 1, 2011.

Jin Woo Moon, "Thermostat Strategies Impact on Energy Consumption in Residential Buildings", Energy and Buildings Sep. 18, 2010.

R.V. Khare, et al., "Development of Personalized Radiant Cooling System for an Office Room", 14th Conference of International Building Performance Simulation Association Dec. 7, 2015.

Yongchao Zhai, et al., "Comfort Under Personally Controlled Air Movement in Warm and Humid Environments", Building and Environment Mar. 27, 2013.

Zhongping Lin, et al., "A study on the thermal comfort in sleeping environments in the subtropics—Developing a thermal comfort model for sleeping environments", Building and Environment Sep. 27, 2006.

Zhongping Lin, et al., "A study on the thermal comfort in sleeping environments in the subtropics—Measuring the total insulation values for the bedding systems commonly used in the subtropics", Building and Environment Jan. 10, 2007.

Anton Tenwolde, et al., "The Effect of Indoor Humidity on Water Vapor Release in Homes", U.S. Department of Energy, Oak Ridge National Laboratory: Buildings X Conference 2007.

Jing Du, et al., "An Experimental Study on the Performances of a Radiation-Based Rask-Ambient Air Conditioning System Applied to Sleeping Environments", Energy and Buildings Jan. 16, 2017.

Jing Du, et al., "A Numerical Study on the Performances of a Radiation-Based Task-Ambient Air Conditioning System Applied to Sleeping Environments", Energy and Buildings Jun. 27, 2017.

Hongsen Shi, et al., "Building Energy Management Decision-Making in the Real World—A Comparative Study of HVAC Cooling Strategies", Journal of Building Engineering Oct. 6, 2020.

E. Wilson, et al., "2014 Building America House Simulation Protocols", NREL/TP-5500-60988 Mar. 1, 2014.

Danny Parker, et al., "Determining Appropriate Heating and Cooling Thermostat Set Points for Building Energy Simulations for Residential Buildings in North America", FSEC-CR-2010-13 May 1, 2013.

Kim Hangstrom, et al., "Calculation Methods for Air Supply Design in Industrial Facilitie", Helsinki University of Technology Laboratory of HVAC 1999.

K. Sumeru, et al., "Effect of compressor discharge cooling using condensate on performance of residential air conditioning system", Proceedings of the 9th International Conference on Thermofluids 2017 Aug. 16, 2018.

M. Amin et al., "Air Curtains of Open Refrigerated Display Cases Revisited—A New Technique for Infiltration Rate Measurements", Transactions on Engineering Sciences Jun. 20, 2008.

Hussmann Corporation, "Proper Air Flow in Vertical Refrigerated Showcase", Refrigeration Industry Website Jan. 30, 2018.

(56) References Cited

OTHER PUBLICATIONS

Ahmad Ali Al-Sahhaf, "Investigation of the Entrainment and Infiltration Rates Through Air Curtains of Open Low-Front Refrigerated Display Cabinets", PhD Dissertation, Brunel University Jan. 1, 2011.
David Stribling, "Investigation into the Design and Optimization of Multideck Refrigerated Display Cases", PhD Dissertation, Brunel University Jul. 1, 1997.
Ninad Maniar, "Heat Transfer Enhancement In A Rectangular Channel Using Vortex Generator In A Laminar Flow", MS Thesis, University of Texas Arlington Jan. 1, 2012.
Syaiful, et al., "Heat Transfer Enhancement in a Rectangular Channel by Means of Vortex Generated by Perforated Concave Rectangular Winglets", Fluids Jan. 17, 2021.
A Toffolo, et al. "Cross-flow Fan Design Guidelines for Multi-Objective Performance Optimization", Proceedings of the Institution of Mechanical Engineers, Part A: Journal of Power and Energy Oct. 23, 2003.
Rania Himeur, et al., "Towards an Accurate Aerodynamic Performance Analysis Methodology of Cross-Flow Fans", Energies Jul. 14, 2022.
James Lenz, "Stresses in Reciprocating Compressor Discharge Tubes During Starting", International Compressor Engineering Conference Jul. 12, 2010.
Ergin Tansdelen, et al., "Investigation of the Effects of Coil Spring on Discharge Tube", International Compressor Engineering Conference Jul. 11, 2016.
Jeong-Bae Lee, et al., "Development of a Miniature Twin Rotary Compressor", International Compressor Engineering Conference Jul. 14, 2014.
Seong-Hyeon Lee, et al., "Vibration Analysis of Compressor Piping System with Fluid Pulsation", Journal of Mechanical Science and Technology Aug. 14, 2012.
D.R. Brown, et al., "The Prospects of Alternatives to Vapor Compression Technology for Space Cooling and Food Refrigeration Applications", Prepared for DOE by Pacific Northwest National Laboratory Mar. 1, 2010.
Mathias Kimmling, et al., "Preliminary Study of Thermal Comfort in Buildings with PV-Powered Thermoelectric Surfaces for Radiative Cooling", International Conference on Improving Residential Energy Efficiency, IREE 2017 2017.
Wendell Porter, et al., "Energy Efficient Homes—Air Conditioning", FCS3262 Oct. 6, 2021.
Danny Parker, "Research Highlights from a Large Scale Residential Monitoring Study in a Hot Climate", Energy and Buildings Nov. 25, 2002.
EnergyStar, "A Guide to Energy Efficient Heating and Cooling", EnergyStar Aug. 1, 2009.
Danielle Pacheco, et al., "Best Temperature for Sleep", The National Sleep Foundation Aug. 1, 2023.
Florida Public Service Commission, "Review of the 2020 Ten-Year Site Plans of Florida's Electric Utilities", Florida Public Service Commission Aug. 1, 2020.
US Energy Information Administration (EIA), "State Energy-Related Carbon Dioxide Emissions by Sector", US EIA 2018.
European Patent Office / International Search Authority, Notification of Transmittal, International Search Report, Written Opinion, PCT/US2024/040590, Dec. 10, 2024.

* cited by examiner

RADIATIVE COOLING DEVICE

FIELD

This disclosure is generally directed to cooling devices and methods, specifically radiative cooling devices and methods, and more specifically, dry surface radiative cooling devices and methods.

BACKGROUND

Heating Ventilation and Air Conditioning (HVAC) systems that typically use vapor-compression refrigeration may include a network of ventilation ducts to transfer air from one location to another. Through these ducts, conditioned air, that is, air heated or cooled by a proximate or adjacent heating and cooling system (depending on whether configured as ductless mini-split or ducted central systems), is distributed to different parts of a structure (e.g., a home or a building). Some vapor-compression systems (e.g., mini-split systems) lack ducts because the cooled air is discharged immediately after it is cooled. In both cases, there is an inside/internal heat exchanger through which piped refrigerant absorbs heat before circulating to an outside heat exchanger where heat is conveyed to the environment.

Conventional HVAC systems are inefficient for individualized, personal needs—which may change throughout the day based on activities like movement throughout a space, or lack thereof such as during sleep—because they blanket the indoor environment with the same cooled air across all spaces. As a result, to cool an individual, the entire space is cooled, resulting in a temperature differential between interior and exterior conditions at the building envelope, and consequent heat gains to the interior and the consumption of energy to remove that heat. A personally-targeted cooling system permits a higher mean temperature in the interior volume, a lower temperature differential at the building envelope, and the potential for energy savings.

Radiative systems may include individual heat exchangers that can be more locally focused and suited for individualized needs. Radiative cooling does not require movement of cold air over a human subject, does not evaporate moisture from the skin or mucus membranes of the eyes, nose, and throat, and thus causes a different (and potentially more comfortable) physiological experience for the subject. As an analogy, radiative cooling mimics the thermal effects of dark nighttime sky whereas conventional convective air conditioning mimics the effects of a cool breeze. However, one significant limitation of radiative cooling systems is that they depend upon cooling radiators that, when operated below the dew point temperature of the ambient air, can cause condensation to form on the cold radiative surface that is exposed to the conditioned space. Condensate can accumulate and drip or pool which can cause discomfort, property damage and human health hazards due to the growth of mold or bacteria.

While there have been attempts at minimizing the accumulation of condensation on exposed cold surfaces, accomplishing this objective in a single compact radiative cooling device has been difficult in the prior art.

What is needed in the art, therefore, is a dry surface radiative cooling device that provides spot cooling to at least one location (bed, desk, chair, etc.) by utilizing the focused benefits of radiative heat removal while mitigating or eliminating exterior condensation.

SUMMARY

In an embodiment, there is a dry surface radiative cooling device. The dry surface radiative cooling device includes at least one ambient air inlet. The dry surface radiative cooling device includes a housing having at least one cooled air outlet. The dry surface radiative cooling device includes a permeable member connected to the housing and having a permeable surface disposed at least partially adjacent to the at least one cooled air outlet. The dry surface radiative cooling device includes a first heat exchanger. The first heat exchanger is separated from the permeable member by a gap. The dry surface radiative cooling device includes a first air flow path disposed at least partially within the housing, extending between the at least one ambient air inlet and the at least one cooled air outlet and through the permeable surface, and at least partially defined by the gap between the surface of the first heat exchanger and the permeable member.

In another embodiment, there is a method for providing spot cooling. The method includes receiving ambient air through an at least one ambient air inlet of a dry surface radiative cooling device. The method further includes forming a cooled air stream from a first volume of the received ambient air, wherein the cooled air stream comprises a lower temperature and lower humidity than a temperature and humidity of the ambient air. The method further includes forming a heat rejection air stream from a second volume of the received ambient air. The method further includes discharging the cooled air stream through an at least one cooled air stream outlet of the dry surface radiative cooling device, wherein the discharging comprises flowing the cooled air stream through a permeable surface of the dry surface radiative cooling device. The method further includes discharging the heat rejection air stream through an at least one heat rejection outlet of the dry surface radiative cooling device. In the method, the forming of the cooled air stream includes flowing the first volume of the ambient air through a first air flow path that extends between the at least one ambient air inlet and the permeable surface through the at least one cooled air outlet, and is at least partially defined by a gap between a surface of a first heat exchanger of the dry surface radiative cooling device and the permeable member, wherein a temperature of the surface of the first heat exchanger is lower than the dew point temperature of the first volume of the ambient air. In the method, the forming of the heat rejection air stream includes flowing the second volume of the ambient air through a second air flow path that extends between the at least one ambient air inlet and the at least one heat rejection outlet.

In yet another embodiment, there is a method for providing spot cooling. The method for providing spot cooling includes providing a dry surface radiative cooling device. The dry surface radiative cooling device includes at least one ambient air inlet. The dry surface radiative cooling device includes a housing having at least one cooled air outlet. The dry surface radiative cooling device includes a permeable member connected to the housing and having a permeable surface disposed at least partially adjacent to the at least one cooled air outlet. The dry surface radiative cooling device includes a first heat exchanger. The first heat exchanger is separated from the permeable member by a gap. The dry surface radiative cooling device includes a first air flow path disposed at least partially within the housing, extending between the at least one ambient air inlet and the at least one cooled air outlet and through the permeable surface, and at least partially defined by the gap between the surface of the first heat exchanger and the permeable member. The method for providing spot cooling includes operating the dry surface radiative cooling device to receive ambient air at the at least one ambient air inlet and form a cooled air stream exiting at the at least one cooled air outlet. The method for providing spot cooling includes maintaining the permeable member at a temperature above the dew point temperature of the cooled air stream and below the dew point temperature of the ambient air.

Advantages of the embodiments include a radiative cooling unit that tolerates and manages humidity in the surroundings while maintaining an externally dry radiative cooling surface. For example, ambient air that is cooled and dehumidified or otherwise conditioned by the dry surface radiative cooling device may be directly recirculated through an air inlet thereof upon exiting at a cooled air outlet thereof. This recirculation advantageously provides for efficient heat transfer because radiative heat that may collect at a radiative surface at the cooled air outlet can be further transferred to the refrigerant circuit via, for example, the cold plate evaporator, concentrated in a heat sink thereof (e.g., a refrigerant), and subsequently jettisoned at a different location such as through at least one heat rejection outlet. Additional advantages of the embodiments will be set forth in part in the description which follows, and in part will be understood from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DETAILED DESCRIPTION OF THE EMBODIMENTS

Figure 1A:
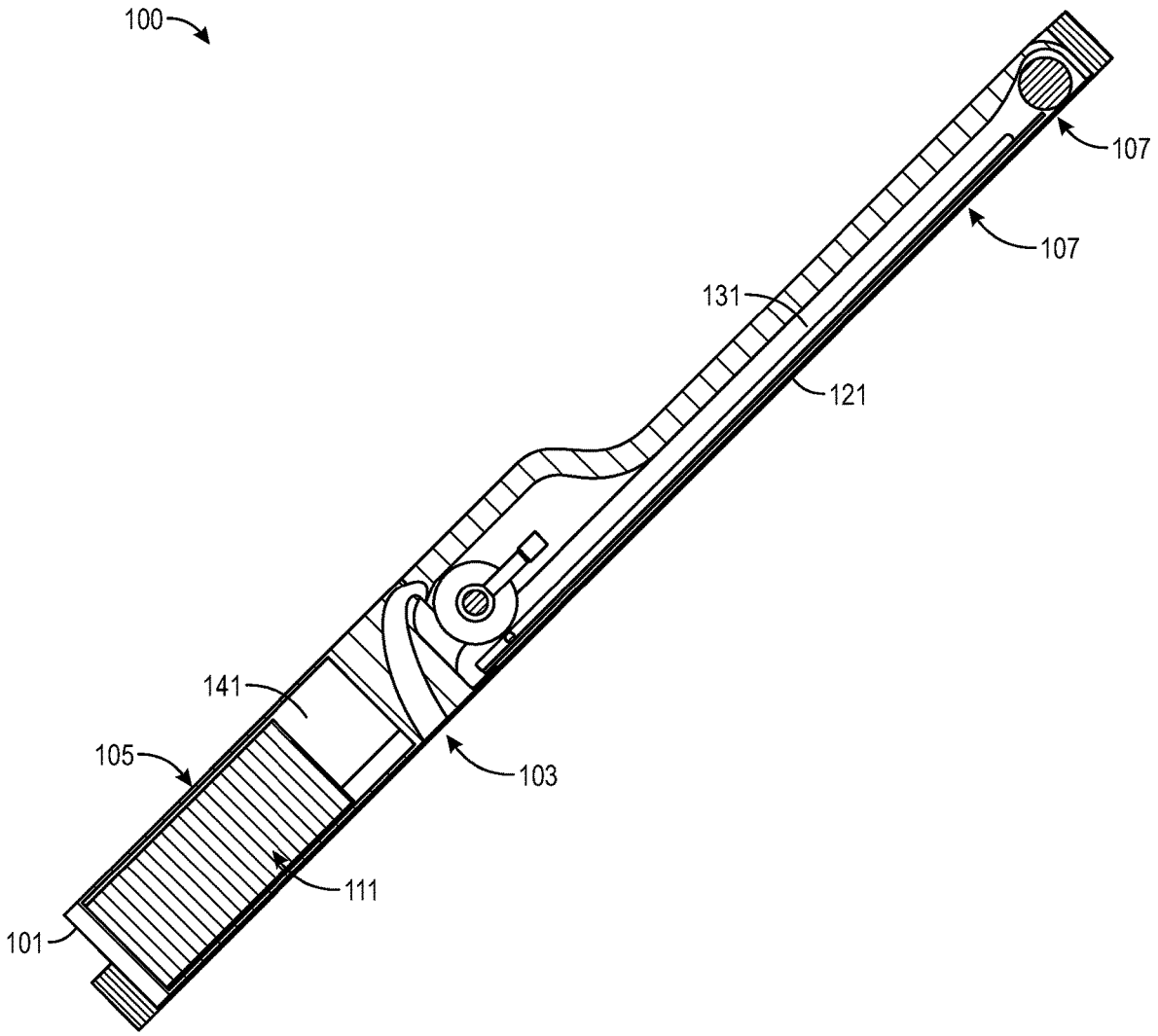
FIG. 1A is a cross-sectional side view of a dry surface radiative cooling device of an embodiment.

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. The precision of any measured and reported numerical value, however, is inherently limited by the standard deviation of relevant measurement errors. Moreover, all ranges disclosed herein are to be understood to encompass any and all sub-ranges subsumed therein.

The following embodiments are described for illustrative purposes only with reference to the Figures. Those of skill in the art will appreciate that the following description is exemplary in nature, and that various modifications to the parameters set forth herein could be made without departing from the scope of the present invention. It is intended that the specification and examples be considered as examples only. The various embodiments are not necessarily mutually exclusive, as some embodiments can be combined with one or more other embodiments to form new embodiments.

The embodiments described herein are capable of integrating multiple benefits, including one or more of: providing for heat transfer between a refrigerant and air, providing for condensate management, providing for radiative cooling and providing for convective cooling. Accordingly, embodiments described herein generally rely on radiant operation and utilize a convective dry air cushion to manage the condensation that is produced as a result cooling relatively humid ambient air to lower than the dew point temperature thereof.

The dry surface radiative cooling device of the embodiments may comprise a housing, a refrigerant circuit, a permeable member, a first air flow path, and a second air flow path. In the examples shown in FIGS. 1A-1G, a dry surface radiative cooling device 100 includes, among other things, a housing 101, a refrigerant circuit 111, a permeable member 121, a first air flow path 131, and a second air flow path 141.

The dry surface radiative cooling device of the embodiments may comprise a housing. For example, as shown in FIGS. 1A-1G, dry surface radiative cooling device 100 includes housing 101. While not limited to any particular material, geometry, size, structure or design, or combination thereof, the housing may be configured to function as a support structure, for example, to support additional features of the dry surface radiative cooling device. Accordingly, the housing may include sidewall portions extending from an exterior surface to an interior surface, as well as internal structural portions that protrude from or connect the interior surface. The housing may also be provided with a visually appealing form factor for the dry surface radiative cooling device. Additionally, the housing may include through-holes, ports, openings and the like to allow for the passage of gas or fluid from one location (e.g., outside of the dry surface cooling device, one space within the dry surface cooling device, etc.) to another location (e.g., inner portion of the dry surface cooling device, another space within the dry surface cooling device, etc.) which may be disposed through sidewalls or internal walls thereof. For example, the housing may comprise at least one ambient air inlet, at least one heat rejection outlet, and at least one cooled air outlet. Additionally, the housing may comprise an integrally formed reservoir and/or at least one weep hole for condensate management.

The housing may be formed of plastic, metal or a combination of plastic and metal. The housing may, therefore, be injection molded, machined, or 3D printed. The housing may comprise more than one portion, for example, removable portions. Examples of removable portions include, but are not limited to, a screen assembly and a back panel.

As discussed above, in an embodiment, the dry surface radiative cooling device may comprise at least one ambient air inlet, at least one heat rejection outlet, and at least one cooled air outlet. Each one of the at least one ambient air inlet, at least one heat rejection outlet, the at least one cooled air outlet, or any combination thereof may be formed as one or more openings that extend through the housing, for example as one or more openings through the housing sidewall.

In the example of FIG. 1A, housing 101 includes at least one ambient air inlet 103, at least one heat rejection outlet 105, and at least one cooled air outlet 107 (not visible from the perspective of the figure). While not limited to any arrangement, the at least one ambient air inlet may comprise a first ambient air inlet and a second ambient air inlet. For example, as shown in more detail in FIGS. 1B-1C, the at least one ambient air inlet comprises first ambient air inlet 103' at a front face and a second ambient air inlet 103" at a rear face.

Figure 1C:
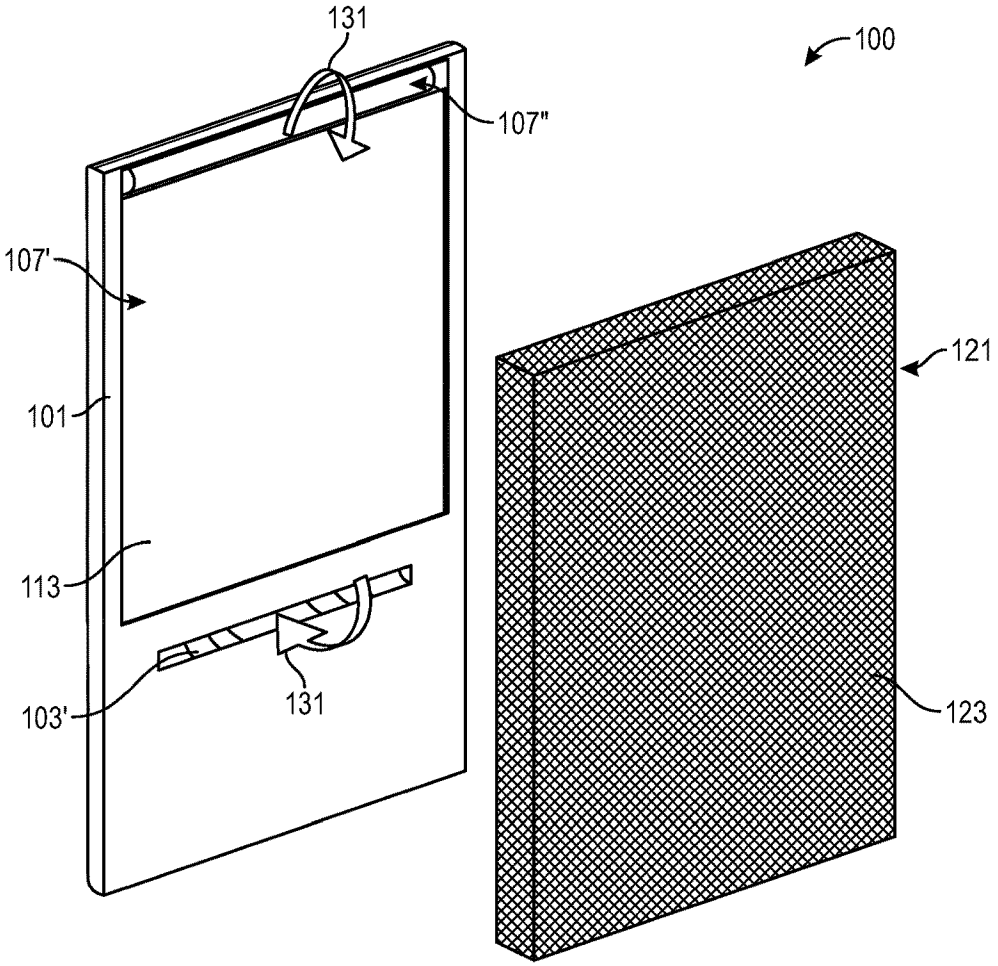
FIG. 1C is a perspective, exploded front-side view of the embodiment shown in FIGS. 1A-1B.

Additionally, while not limited to any arrangement, the at least one cooled air outlet may comprise a plurality of cooled air outlets. In an embodiment the dry surface radiative cooling device may comprise a first cooled air outlet and a second cooled air outlet. The second cooled air outlet may be an optional cooled air outlet. For example, as shown in FIG. 1C, dry surface radiative cooling device 100 includes a first cooled air outlet 107' and a second cooled air outlet 107". As shown, the first cooled air outlet 107' encompasses an unenclosed volume adjacent to an exposed surface of a heat exchanger (such as a surface of an evaporator cold plate as described below) which may extend adjacent to permeable member 121. That is, the first cooled air outlet 107' may be at least partially defined by a gap extending between permeable member 121 and an evaporator cold plate surface. Permeable member may be configured in a manner to allow conditioned air exiting at the first cooled air outlet 107' to flow through it. While not limited to any particular theory, air exiting dry surface radiative cooling device 100 at the first cooled air outlet 107' provides for keeping a surface of the permeable member 121 substantially dry due to the device being operated in such a manner that air that flows through the first air flow path is conditioned so that upon reaching the first cooled air outlet 107' it has a dew point that is lower than the surface temperature of the permeable member. While optional, the second cooled air outlet 107" may extend through at least one opening comprising a nozzle, a slot, or combinations thereof. And while not limited to any particular style of opening, it is believed that a slot projects the exiting air further into a surrounding space (e.g., a room) as compared to a nozzle having the same total open area and, therefore, distributes conditioned air across a wider space.

Figure 1B:
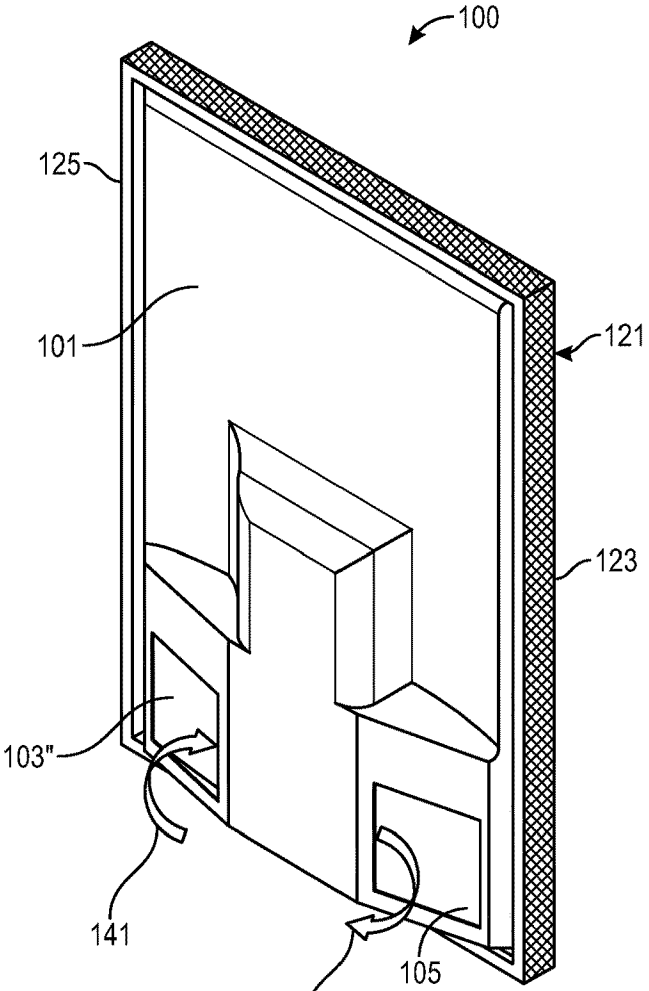
FIG. 1B is a perspective back-side view of the embodiment shown in FIG. 1A.
Figure 1E:
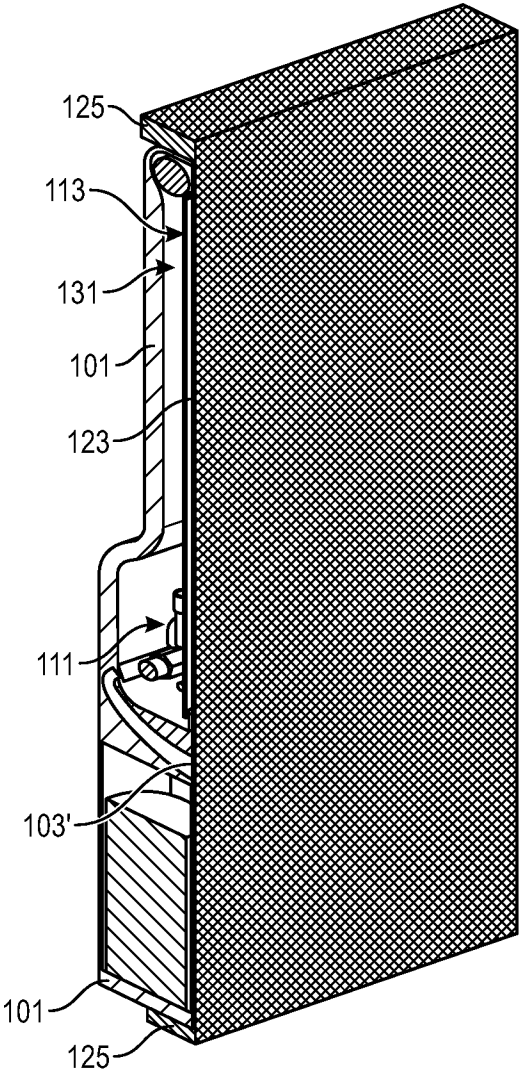
FIG. 1E is a cut-through, perspective front view of the embodiment shown in FIGS. 1A-1D.
Figure 1D:
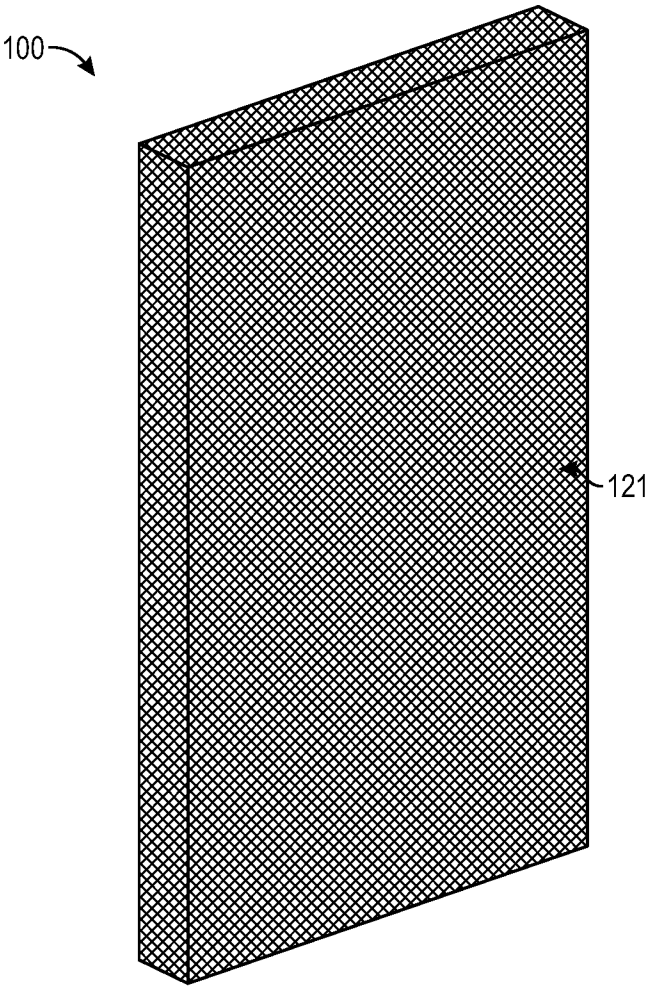
FIG. 1D is a perspective front-side view of the embodiment shown in FIGS. 1A-1C.

As described above, embodiments of the dry surface radiative cooling device may include a permeable member. For example, as shown in FIG. 1A, dry surface radiative cooling device 100 includes permeable member 121. As illustrated, the permeable member 121 is backed by a heat exchanger, such as a first heat exchanger which can be a cold plate evaporator (described below). The permeable member may be fixed permanently or may be detachably connected to the housing. In an embodiment, the permeable member may be removed from the housing for cleaning and reuse, or disposal and replacement. That is, the permeable member may be reused by reattaching to the housing or replaced completely with another permeable member attached to the housing. In an embodiment, the permeable member may be detachably connected to the housing and may comprise a permeable surface disposed at least partially adjacent to the at least one cooled air outlet. For example, as shown in FIGS. 1B-1D, the dry surface radiative cooling device includes a permeable member 121 detachably connected to the housing 101. For example, the permeable member 121 is shown attached to housing 101 in FIG. 1B, detached from housing 101 in FIG. 1C, and once again attached to the housing in FIG. 1D.

In an embodiment, the permeable member may include a permeable surface. For example, as shown in more detail in the perspective cross-sectional view of FIG. 1E, the permeable member 121 includes a permeable surface 123 disposed at least partially adjacent to the at least one cooled air outlet at first cooled air outlet 107'.

The permeable surface may be selected such that it is permeable to air, heat radiation, or both. That is, air traversing an air flow path (described below) through the dry surface radiative cooling device and exiting the at least one cooled air outlet may further pass through the permeable surface. Accordingly, the permeable surface may comprise a plurality of openings through which air can pass. In embodiments, the permeable surface may comprise one or more of screen (mesh), perforated plate, sponge, foam, paper, cardboard, or the like, including combinations thereof. The permeable surface may comprise a metal sheet formed with holes and/or slits. The permeable surface may be 3D printed, extruded, machined or woven. In an example, as illustrated in FIGS. 1B-1E, the permeable surface is a screen mesh.

The permeable surface may also serve as a radiative surface such that it accepts heat radiation from its surroundings and transfers that heat radiation to other locations of the surroundings. The permeable surface may comprise a surface coating, for example, a coating that enhances radiative transfer of heat between an external body (e.g., a person) and the permeable surface itself (e.g., a screen mesh).

The permeable member may be flexible such that it may be stretched, bent, compressed, or a combination thereof. The permeable member may be resilient. The permeable member may be rigid. The permeable member may be pliable. Portions of the permeable member may be rigid (e.g., a perimeter thereof forming a frame) and other portions may be flexible (e.g., an interior portion thereof forming the permeable surface). Accordingly, in embodiments, the permeable member may include a frame to which the permeable surface is attached. For example, as illustrated in FIGS. 1B-1E, permeable member 121 includes a frame 125 to which the permeable surface 123 is attached. In an embodiment, the permeable surface is detachably connected to the frame. That is, the permeable surface may be detached from the frame and then reattached to the frame. In embodiments, the permeable member does not comprise a frame to which the permeable surface is attached, and the permeable surface may be detachably connected to the housing. For example, the permeable surface may be fastened to the housing with screws, nails, staples or the like, may be adhered to the housing with an adhesive, or may be bonded to the housing via plastic weld or other heat treatment such as melting together.

In embodiments, the permeable member comprises a canvas attached to a frame, where the frame is detachably secured to the housing. While not limited to any particular configuration, the permeable member may be selected such that there may be a painting or photograph printed on an outer/front-facing side of the permeable surface.

The dry surface radiative cooling device may include a heat accepting portion and a heat rejecting portion. While not limited to any specific configuration, in an embodiment the heat accepting portion and heat rejecting portion may comprise a refrigerant circuit, thermoelectric circuit, or any such technology capable of accepting, transporting and rejecting heat.

In an embodiment, the dry surface radiative cooling device may include a refrigerant circuit disposed at least partially within the housing. For example, as shown in FIG. 1A, the refrigerant circuit 111 is disposed at least partially within housing 101.

Figure 1F:
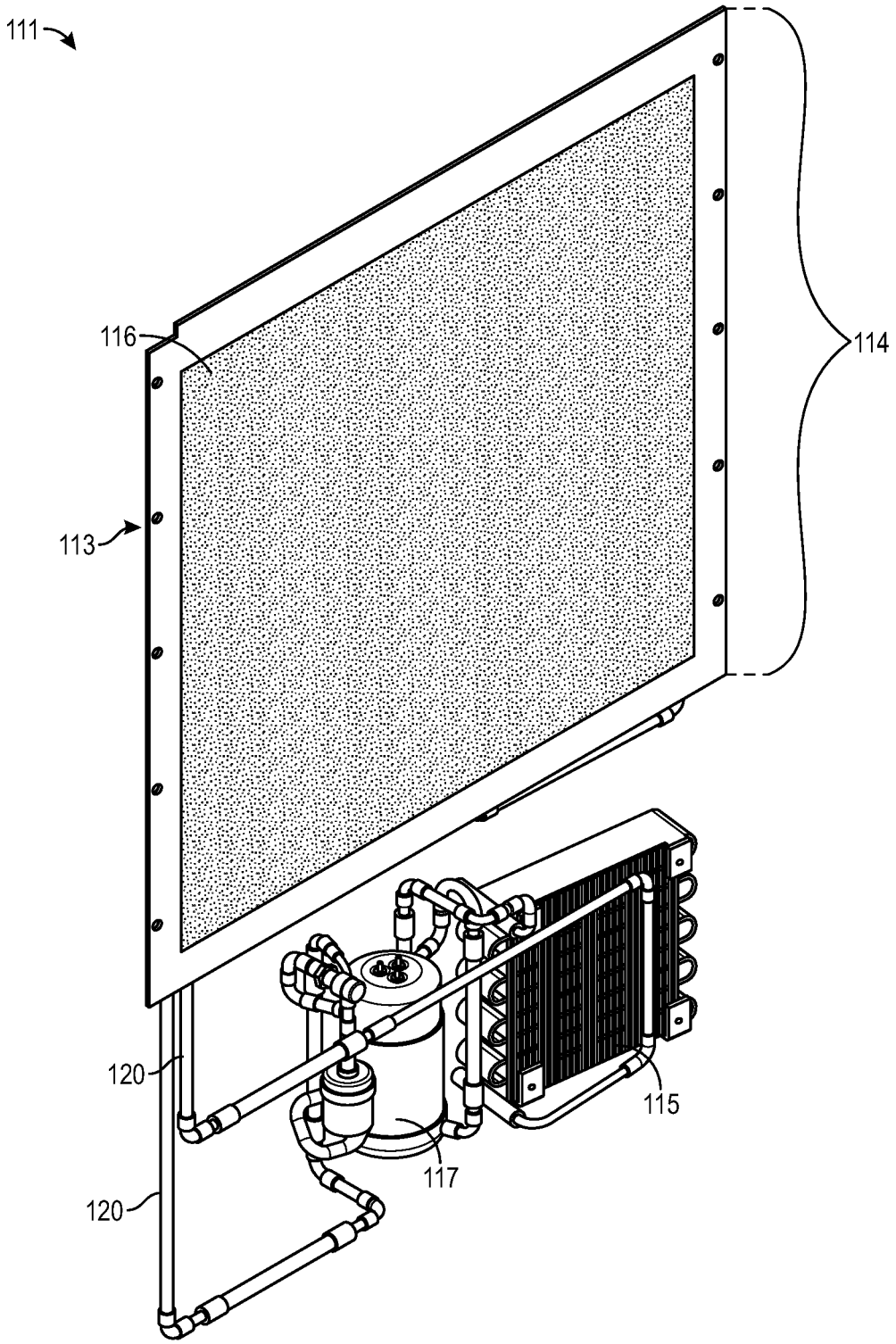
FIG. 1F is an isolated, perspective front-side view of a refrigerant circuit of the embodiments shown in FIGS. 1A-1E.
Figure 1G:
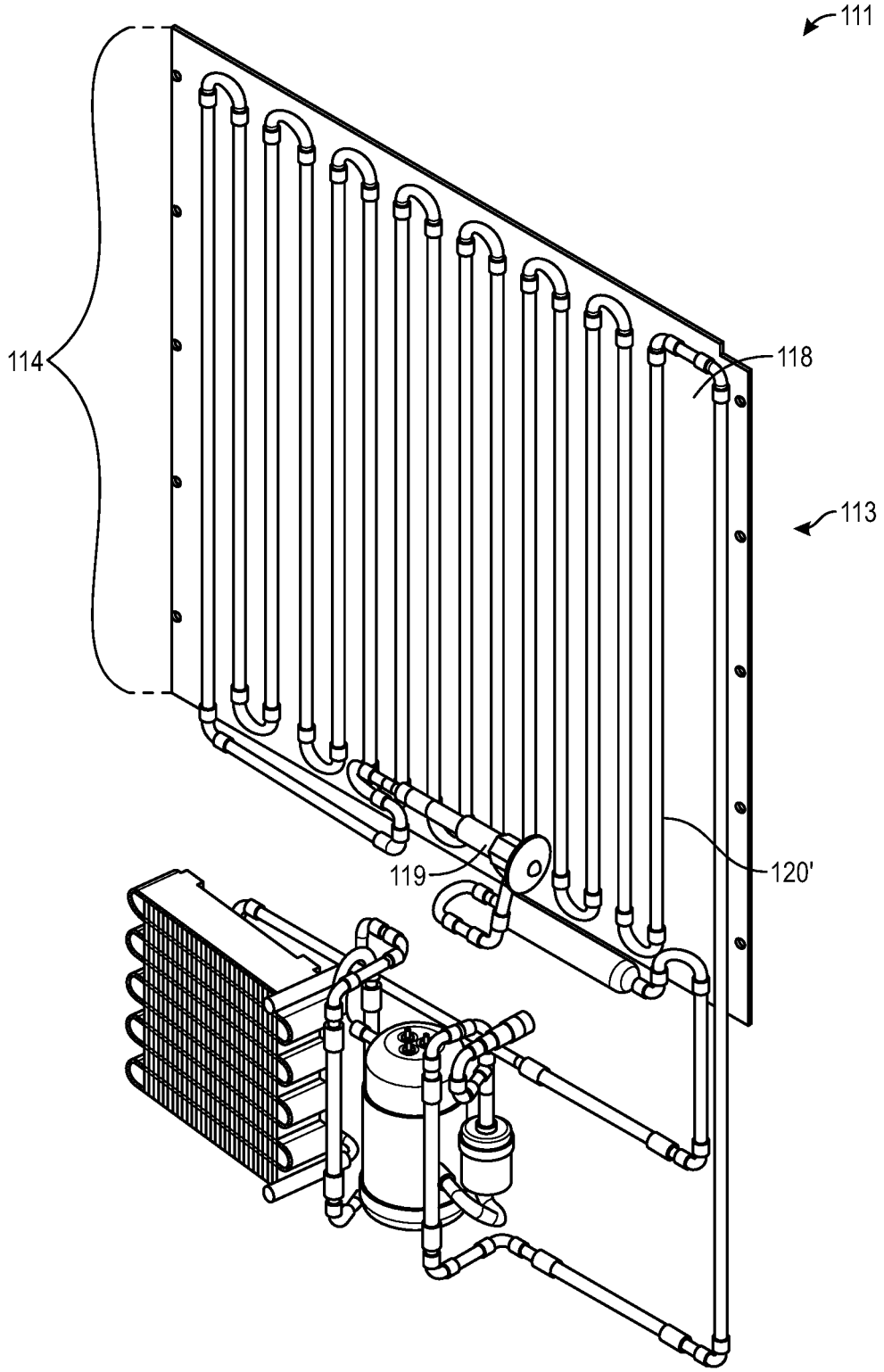
FIG. 1G is an isolated, perspective back-side view of a refrigerant circuit of the embodiments shown in FIGS. 1A-1F.
Figure 1I:
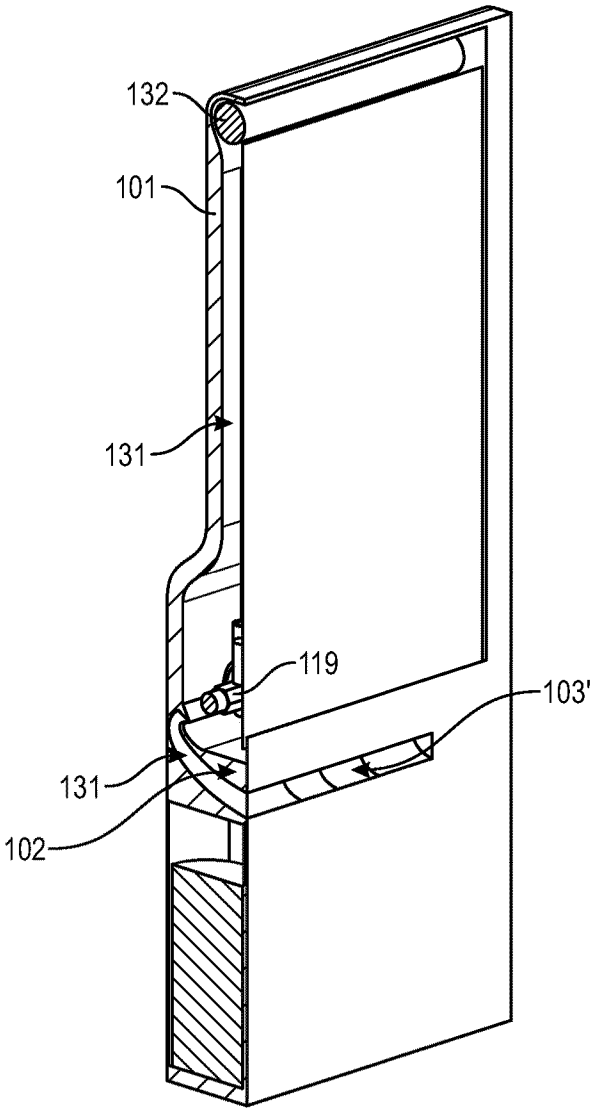
FIG. 1I is a cut-through perspective view of the embodiment shown in FIGS. 1A-1H.

While not limited to any particular configuration, arrangement, type, design, layout or combination of equipment, the refrigerant circuit may include, for example, a vapor compression refrigerant circuit. Accordingly, the refrigerant circuit may include a first heat exchanger, a compressor, a second heat exchanger, and an expander. The first heat exchanger, compressor, second heat exchanger, and expander may be connected by a refrigerant conduit. In an embodiment, refrigerant is plumbed in through a refrigerant conduit that connects from a compressor to a heat exchanger, then to an expansion device and then to another heat exchanger, looping back to the compressor. The first heat exchanger may be configured to absorb heat. Accordingly, the first heat exchanger may be a heat absorber. The second heat exchanger may be configured to reject heat. Accordingly, the second heat exchanger may be a heat rejector. For example, as shown in FIGS. 1E-1G, dry surface radiative cooling device 100 includes refrigerant circuit 111 disposed at least partially within housing 101. As illustrated, refrigerant circuit 111 includes a first heat exchanger 113, a second heat exchanger 115, a compressor 117 and an expander 119. And as seen in further detail in FIGS. 1F-1G, first heat exchanger 113, second heat exchanger 115, compressor 117 and expander 119 are connected by a refrigerant conduit 120.

In an example, the first heat exchanger may comprise a heat accepting device, such as a heat absorber, including an evaporator. To accept heat from an ambient air stream, the first heat exchanger may operate at a temperature that is lower (colder) than that of the ambient air stream.

While not limited to any particular heat exchanger, the first heat exchanger may be a cold plate evaporator. The use of an evaporator provides for both reducing the temperature and the absolute humidity of inlet ambient air (i.e., air that is circulated through the dry surface radiative cooling device from the environment within which it is being utilized). The cold plate evaporator may include a thermally conductive plate in thermal communication with a network of cooling coils extending from and connected with the refrigerant conduit. In the example refrigerant circuit 111 illustrated in FIGS. 1F-1G, the first heat exchanger 113 is a cold plate evaporator that includes a thermally conductive plate 114 in physical contact and thermal communication with a network of cooling coils 120' extending from and connected with the refrigerant conduit 120. As can be seen more clearly in FIG. 1G, the network of cooling coils 120' are in physical contact and thermal communication with thermally conductive plate 114. In embodiments, the network of cooling coils may be in physical contact with the thermally conductive plate. For example, the network of cooling coils may be bonded to the thermally conductive plate. In embodiments, the network of cooling coils may be incorporated within the thermally conductive plate. For example, the cold plate evaporator may comprise a roll bond evaporator plate. The roll bond evaporator plate can be formed of two segments of material, such as aluminum, each having a shaped form that, when brought into contact with one another during fabrication (e.g., pressed together), form the thermally conductive plate as well as the network of cooling coils configured for connecting with the refrigerant conduit and transporting of refrigerant within the roll bond evaporator plate.

To minimize the formation of condensate on the first heat exchanger, a surface thereof (i.e., a front surface facing the permeable member) may comprise a substantially flat surface. In this way, condensate that may form on the surface is minimized in both volume and quantity, and such drops that form are induced to roll down along the surface while remaining attached to it by surface tension, without encountering obstacles that would cause them to aggregate or detach from the surface, thereby further reducing or eliminating the occurrence of condensate droplets dripping onto the permeable member and/or person(s) gathered near the dry surface radiative cooling device. In embodiments, first heat exchanger may comprise a surface facing the permeable member. To increase radiative properties of the first heat exchanger, this surface may comprise a treated surface. In an example shown in FIG. 1F, the first heat exchanger is a cold plate evaporator having a thermally conductive plate 114 that includes treated surface 116. The treated surface may comprise a radiative surface. The treated surface may be a coating. The treated surface of the first heat exchanger may include a coating with a high emissivity. For example, the treated surface's coating may be a coating with high emissivity relative to non-treated surface portions of the cold plate evaporator. The coating may be a deposited coating or an adhered coating such as a polymer adhesive film.

While not limited to any particular orientation or directionality, the treated radiative surface may be a surface of the first heat exchanger that faces the permeable member. Accordingly, a person seeking spot cooling may orient themselves in a line of sight with the front surface of the first heat exchanger that faces the permeable member such that radiative heat transfer occurs between the person and the first heat exchanger. To increase heat exchange, the treated surface may be a high emissivity coating having a matte black finish. The coating may comprise a matte black adhesive vinyl coating. Alternatively, or in combination with the vinyl coating, the coating may comprise a high emissivity paint, such as a matte black paint.

In other embodiments, a surface of the heat exchanger may not be treated and may have inherently desirable properties such as high emissivity and/or hydrophobicity. In still other embodiments, the heat exchanger may comprise a treated surface that has both high emissivity as described above and is hydrophobic. The treated surface, therefore, may include a hydrophobic coating. The coating described above may be highly emissive as well as hydrophobic. Accordingly, with a hydrophobic surface, condensate that forms on the heat exchanger will tend to bead rather than pool and can more controllably roll down rather than drip off the first heat exchanger, such as a thermally conductive plate of a cold plate evaporator. In this way, condensate that forms on and rolls down the surface of the evaporator can be collected at a condensate manager.

The first heat exchanger may further comprise another surface that does not face the permeable member. As illustrated across FIGS. 1F-1G, first heat exchanger 113 is a cold plate evaporator comprising a thermally conductive plate 114 having a treated surface 116 that faces the permeable member 121 and a back surface 118. While not limited to any particular configuration or geometry, the back surface may be oriented so that it does not face the permeable member and is not in a line of sight with a person seeking spot cooling. For example, the back surface may face an inner wall portion of the housing as illustrated in more detail in FIG. 1J below. At least a volume portion of ambient air transported in the first air flow path may initially contact the first opposing surface. Heat from the ambient air, therefore, may be transported through the first opposing surface to refrigerant circulated through the first heat exchanger.

To assist with heat exchange and maximize convective heat transfer, the ambient air through the first air flow path may be transported via turbulent flow. Accordingly, the back surface may comprise heat transfer enhancement features such as, but not limited to, fins, vortex generators and other characteristics to enhance surface area thereof. Accordingly, ambient air transported through the first air flow path contacts the first opposing surface and the first heat exchanger serves to dehumidify and cool the air as much as possible prior to exiting the dry surface radiative cooling device at, for example, the at least one cooled air outlet.

In embodiments, thermoelectric cooling, separately alone or in combination with a vapor compression system can be used for cooling the air. For example, a Peltier cooler may provide solid state cooling.

The dry surface radiative cooling device's refrigerant circuit may further comprise a second heat exchanger. The second heat exchanger may be configured for rejecting heat (i.e., as a heat rejector), such as heat that is transferred to the first heat exchanger from air that is received through the ambient air inlet and stored in the refrigerant before being transported through the refrigerant conduit and transferred to the second heat exchanger, back into the environment. In other words, air entering through an ambient air inlet, such as a second ambient air inlet (e.g., second ambient air inlet 103" in FIG. 1B) may follow an air flow path disposed at least partially within the housing and extending between the at least one ambient air inlet and the at least one heat rejection outlet so as to undergo heat exchange with the second heat exchanger.

Figure 1H:
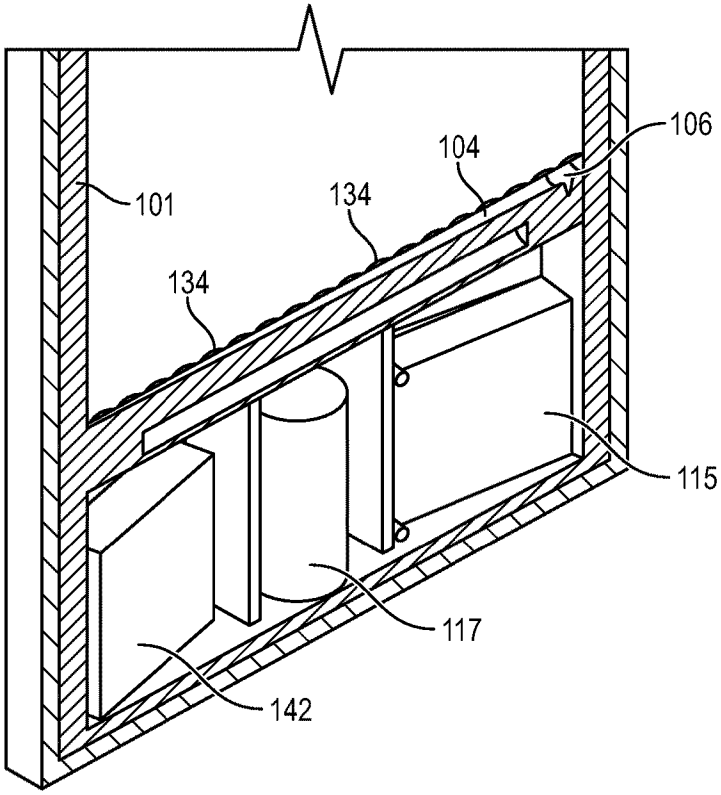
FIG. 1H is a cut-through perspective view of a lower portion of the embodiment shown in FIGS. 1A-1G.

In an embodiment, the second heat exchanger is disposed in the housing. For example, as illustrated in FIGS. 1F-1H, second heat exchanger 115 is disposed in housing 101. Alternatively, the second heat exchanger may be disposed external to the housing (as in a mini-split system). In other words, the second heat exchanger may be disposed outside of the housing. For example, a condensing unit comprising the second heat exchanger may be placed in a location adjacent to but external to the housing. In another example, a condensing unit comprising the second heat exchanger may be placed a distance from the housing. In such an embodiment, similar to a mini-split system, the refrigerant circuit can include refrigerant conduit extensions (hoses or additional tubing) to transport refrigerant to/from the second heat exchanger.

In embodiments, the second heat exchanger may be an air-cooled heat exchanger, a water-cooled heat exchanger, or an evaporative heat exchanger.

The refrigerant circuit may include a compressor. As shown in FIGS. 1F-1H, refrigerant circuit 111 includes compressor 117. While not limited to any particular configuration or type, the compressor may be a rotary compressor or a reciprocating compressor. To limit noise, the compressor may be vibrationally isolated and/or acoustically insulated from other portions of the dry surface radiative cooling device as well as users.

The refrigerant circuit may include an expander. As shown in FIGS. 1F-1H, refrigerant circuit 111 includes expander 119. The expander may be selected from an expansion device such as an expansion valve or a capillary tube. While not limited to any particular configuration or type, in embodiments the expander may be controlled thermally (e.g., with a sensing bulb or electronically with a thermocouple (or similar device) in communication with a control system. Accordingly, the expander may comprise a thermal expansion valve (TXV) or an electronic expansion valve (EXV). The expansion device may be disposed downstream of the second heat exchanger (condenser) in the refrigerant circuit.

The refrigerant circuit transports a refrigerant as a heat transfer medium. While not limited to any particular type of refrigerant, example refrigerant includes non-flammable refrigerant, such as R134a, a refrigerant grade propane such as R290, a refrigerant iso-butane such as R600a, and the like.

Figure 1J:
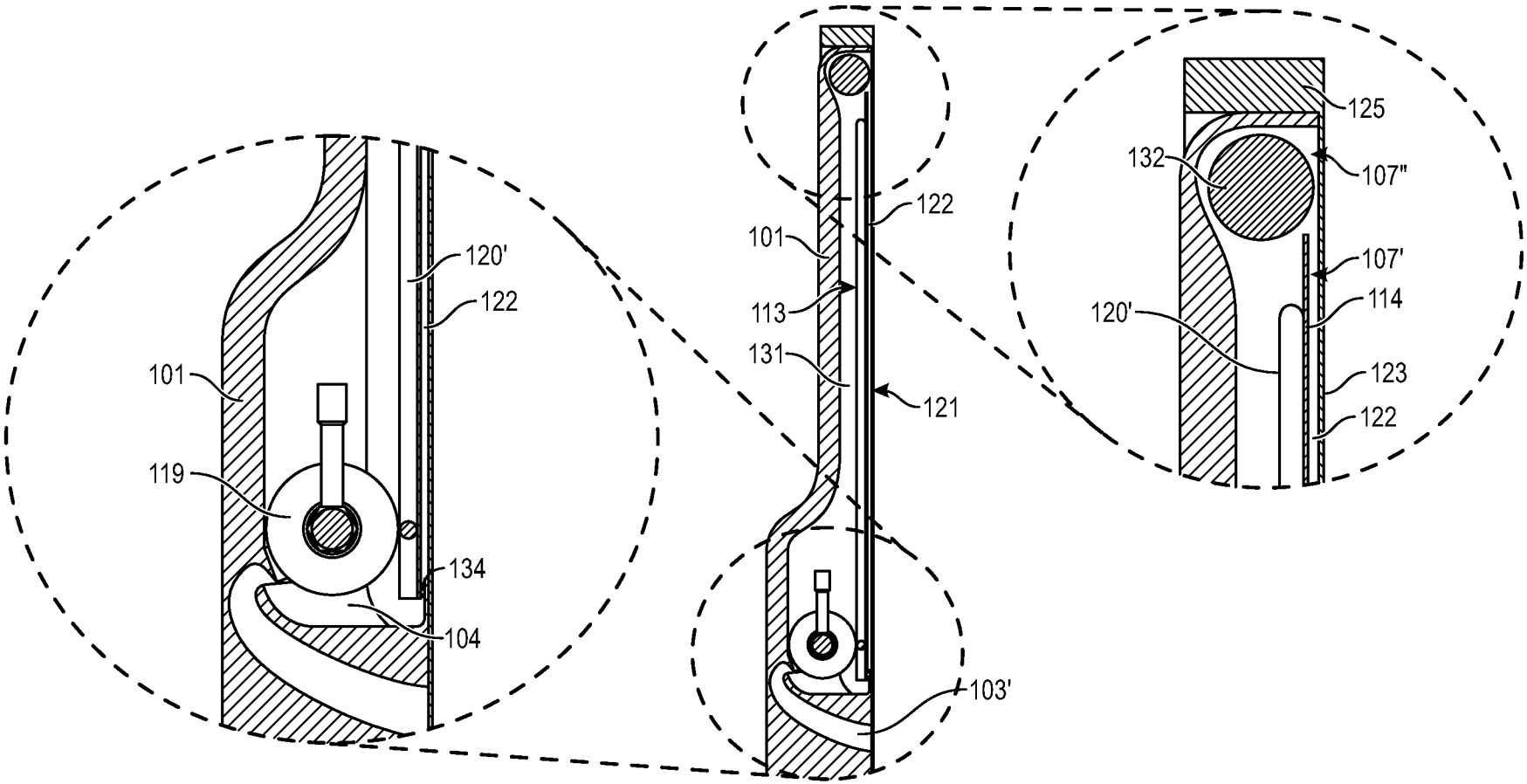
FIG. 1J is a cross-sectional side view of an upper portion of the embodiment shown in FIGS. 1A-1I.

The first heat exchanger may be separated from the permeable member by a gap. For example, as shown in FIG. 1J, first heat exchanger 113 is separated from the permeable member 121 by a gap 122. As shown in more detail by the right-hand-side inset in FIG. 1J, gap 122 separates permeable surface 123 and the surface of the thermally conductive plate 114 (i.e., front surface of the first heat exchanger) that faces the permeable member. Accordingly, an air flow path, such as the first air flow path disposed at least partially within the housing that extends between the at least one ambient air inlet and the permeable surface through the at least one cooled air outlet, may be at least partially defined by the gap between the first heat exchanger and the permeable member.

The gap may separate the permeable screen and the thermally conductive plate by a distance. The distance may be selected such that the permeable member is disposed as close as possible to the first heat exchanger, but not so close that condensate that forms on the front side of the heat exchanger that faces the permeable member wets the permeable member. The distance may be from greater than 0 to about 1". The distance may measure from about ⅛" to about 1", or from greater than 0 to about ⅛". The distance may measure from about 3/16" to about ⅝". In an example, the distance may measure from about ⅛" to about 3/16". More specifically, in an example, the distance may measure about ⅛".

The gap may be substantially uniform between the first heat exchanger and the permeable member. Alternatively, the gap may not be uniform between the first heat exchanger and the permeable member. For example, the gap may be tapered such that the distance increases or decreases. This may be achieved by configuring one of or both the thermally conductive plate and the permeable surface to be offset by a predetermined or adjustable angle from one another, or by providing one of or both the cold plate evaporator and the permeable member as having a tapered design.

As described above, the dry surface radiative cooling device may further include a first air flow path and a second air flow path.

In an embodiment, the first air flow path may be disposed at least partially within the housing, extending between the at least one ambient air inlet and the at least one cooled air outlet and through the permeable surface. In an embodiment, the second air flow path may be disposed at least partially within the housing, extending between at least one ambient air inlet and the at least one heat rejection outlet.

While not limited to any particular configuration, the at least one cooled air outlet and the at least one heat rejection outlet may be connected to a common one of the at least one ambient air inlet.

Alternatively, the at least one cooled air outlet and the at least one heat rejection outlet may instead be separately connected to respective one of the at least one ambient air inlet. For example, in FIGS. 1B-1L, dry surface radiative cooling device 100 includes first air flow path 131 disposed at least partially within the housing 101, extending between the at least one ambient air inlet 103 and the at least one cooled air outlet comprising first cooled air outlet 107' and, optionally, second cooled air outlet 107", and through the permeable surface 123 as well as second air flow path 141 disposed at least partially within the housing 101, extending between a second ambient air inlet 103" and the at least one heat rejection outlet 105.

Figure 1K:
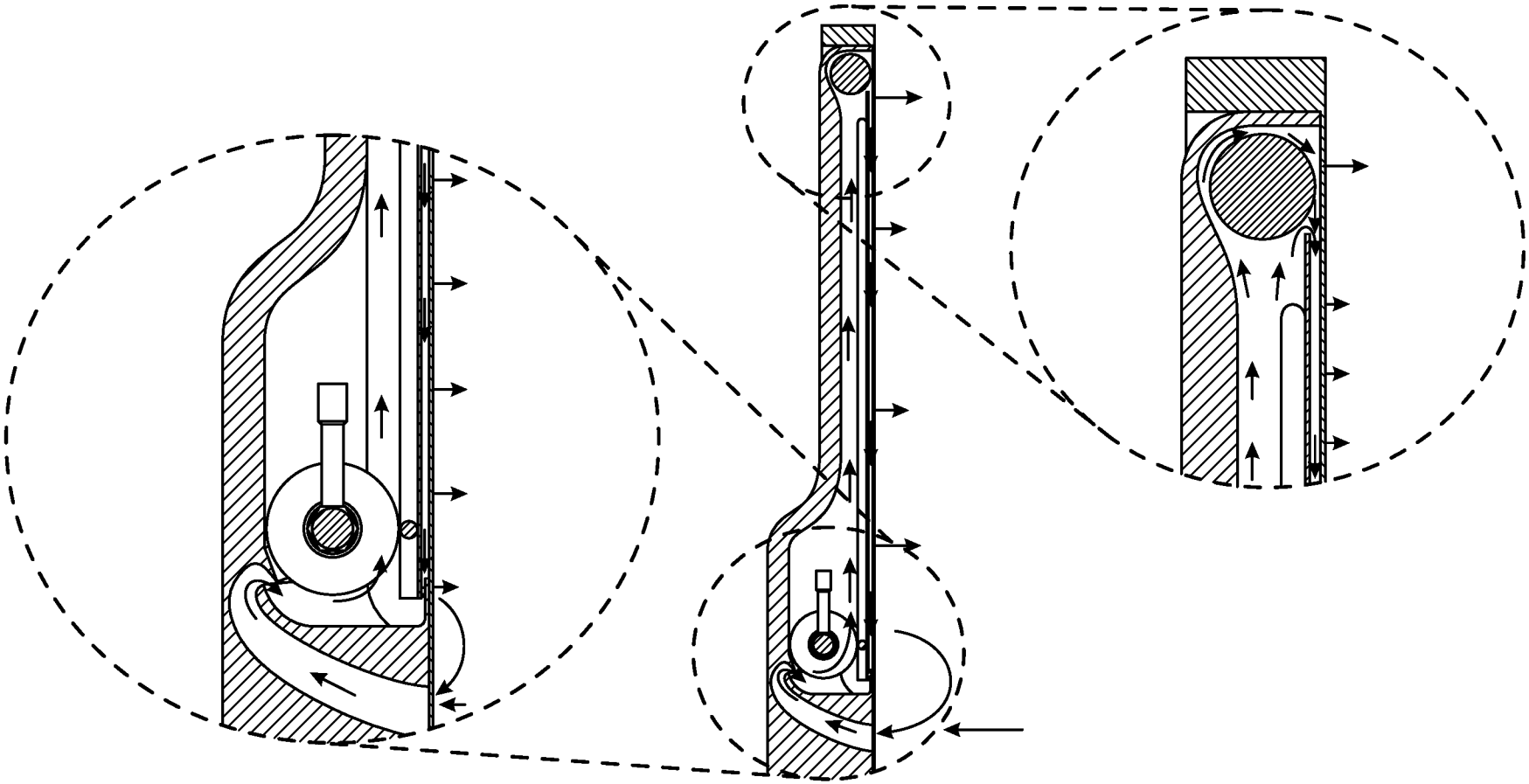
FIG. 1K is a copy of FIG. 1J with labels removed and superimposed exemplary air flows added.

As illustrated in more detail in FIGS. 1J-1K, for example, the first air flow path 131 may at least partially occupy the gap 122. As illustrated in FIG. 1K, air flow (represented by solid arrows) is superimposed over the images of FIG. 1J to illustrate its travel through the first air flow path 131. Air enters at the first ambient air inlet 103', continues to travel as it contacts the back surface of the first heat exchanger 113 where it is cooled and at least partially dehumidified, travels through the gap 122 where it contacts the front surface of the first heat exchanger 113 (such as the surface of the first heat exchanger that faces the permeable member) and may be further cooled and dehumidified before exits through the permeable surface 123 at the at least one cooled air outlet 107, for example, the first cooled air outlet 107'. Although a portion of cooled air exiting at the first cooled air outlet 107' substantially mixes with ambient air, some portion of the cooled air may be drawn by lower pressure at the first ambient air inlet 103' and may re-enter the device and travel again through the first air flow path 131. Accordingly, in an embodiment, the first ambient air inlet may be configured to accept, substantially in real-time, at least a fraction of conditioned air exiting the at least one cooled air outlet.

Optionally, at least a portion of the volume of air traveling through the first air flow path 131 may exit at the second cooled air outlet 107" (for example, through an optional nozzle) to provide a focused blast of convective cooling to the environment, while another portion of the volume of air continues its travel at gap 122, exiting through the permeable surface 123 at a first cooled air outlet 107'.

In order to both draw in new air from the environment and force air to flow through the air flow paths, the dry surface radiative cooling device of the embodiments may further comprise at least one fan. The at least one fan may be disposed within the first air flow path. The at least one fan may be disposed within the second air flow path. In an embodiment, the at least one fan comprises an at least one first fan disposed in the first air flow path, such as between the at least one ambient air stream inlet and the at least one cooled air outlet, and at least one second fan disposed in the second air flow path, such as between the at least one ambient air stream inlet and the at least one heat rejection outlet. For example, as shown in FIGS. 1H-1K, the dry surface radiative cooling device 100 includes cooled air stream fan 132 disposed between the first ambient air stream inlet 103' and the at least one cooled air outlet 107 while in FIGS. 1A-B a heat rejection stream fan 142 is shown disposed between the second ambient air stream inlet 103" (as visible in FIG. 1B) and the at least one heat rejection outlet 105 (as visible in FIG. 1A).

The at least one fan may comprise at least one variable speed fan. The dry surface radiative cooling device may include a controller that controls a speed of the at least one fan. For example, the controller can be utilized to change the speed of air flow based on a sensed condition, e.g., humidity/temperature at a discharge location of conditioned air.

To assist with the collection and flow of air entering at the first ambient air inlet 103' as controlled via cooled air stream fan 132, while minimizing or eliminating humid ambient air from being drawn in and thereby wetting the permeable member (causing a risk of pooling or dripping), at least one intake restrictor may be provided adjacent an end of the gap separating the first heat exchanger from the permeable member. For example, as shown in the left-side inset of FIG. 1J, dry surface radiative cooling device 100 further includes at least one intake restrictor 134 disposed at an end portion of gap 122 between the thermally conductive plate 114 of the cold plate evaporator and permeable surface 123 and secured by an inner wall portion of housing 101. The intake restrictor may be incorporated as part of a condensate manager as discussed below. While not limited to any particular theory or function, in an embodiment the intake restrictor in combination with at least one weep hole are provided to allow condensate to be transported, for example, to the condensate tray, while minimizing the amount of air that would otherwise be suctioned through a portion of the permeable member closest to the condensate tray. That is, the intake restrictor provides for separating high pressure air discharged by the fan from a low pressure air being pulled into the device through and through the first air flow path. Accordingly, it is believed that by eliminating or minimizing ambient air from flowing from the environment through the permeable member and to a bottom portion of the first heat exchanger, the risk of forming unwanted condensate on a portion of the permeable member is eliminated or reduced. In an embodiment, the at least one intake restrictor comprises a plurality of intake restrictors. For example, a plurality of intake restrictors 134 are shown in FIG. 1H. Between each of the plurality of intake restrictors may be disposed one or more weep holes to allow condensate to flow through while minimizing the amount of air flowing through a condensate collection reservoir. In embodiments, the at least one intake restrictor comprises a continuous intake restrictor extending substantially the length of and adjacent to a bottom edge of, for example, the cold plate. The continuous intake restrictor may be used instead of a plurality of intake restrictors.

As humid ambient air travels through the first air flow path, condensate forms on the first heat exchanger. In the case of a cold plate evaporator such as that described above, condensate forms on the back surface thereof (as the air first travels past this surface) and on the front surface thereof facing the permeable member (possibly to a lesser degree as the air, now less humid, continues past this surface). Such condensate may be collected at the condensate manager. Accordingly, in embodiments, the dry surface radiative cooling device may further comprise a condensate manager. For example, as illustrated across FIGS. 1H-1I, dry surface radiative cooling device 100 includes a condensate manager 102. The condensate manager may be disposed adjacent to the first heat exchanger (i.e., the cold plate evaporator). Accordingly, the condensate manager may be configured for collecting the condensate that is formed on the first heat exchanger. In an embodiment, the condensate manager includes a drain line for transferring collected condensate to a different location. In an embodiment, the condensate manager includes a collection reservoir that may be periodically emptied.

In embodiments, the condensate manager or at least a portion thereof may be formed as part of the structure of the housing. In embodiments, the condensate manager or at least a portion thereof may be removably connected with the housing.

The condensate manager or at least a portion thereof, may be disposed at a location where condensate is transported either by gravity or by an applied force such as that provided by the air traveling through the first air flow path. In an embodiment, therefore, the condensate manager or at least a portion thereof may be disposed adjacent to an end of the first heat exchanger, such as adjacent to an end of a cold plate evaporator.

In an embodiment, the condensate manager may be arranged such that at least a portion of condensate volume that forms on the first heat exchanger, such as by condensation of water from high-humidity air transported through the first air flow path, and moves along a surface thereof via gravity and/or by force such as by an applied force such as that provided by the air traveling through the first air flow path, is collected.

Accordingly, the condensate manager may comprise at least one condensate collection reservoir. For example, as illustrated in FIG. 1H as well as FIGS. 1J-1I, the condensate manager 102 includes condensate collection reservoir 104. The condensate collection reservoir may comprise a portion of the housing. The condensate reservoir may comprise a separate condensate collection tray disposed in the housing. The condensate collection reservoir may comprise a condensate collection tray that is removably disposed in the housing. For example, the condensate collection tray may be removed from the housing (such as to empty it of accumulated volume of condensate) and reinserted (or replaced by a new condensate collection tray) in the housing. In an embodiment, rather than a condensate tray the condensate reservoir may comprise a bucket where condensate formed on the first heat exchanger drips down to or eventually transported to. In an embodiment, in addition to a single condensate collection reservoir, the condensate manager may further comprise a second collection reservoir. The second collection reservoir may comprise a bucket. The second collection reservoir may comprise a condenstate collection tray.

Collected condensate, such as condensate that is directed to a first condensate reservoir, may then be transferred to another location, such as the second collection reservoir. This may be accomplished, for example, via holes that extend through the first condensate collection reservoir that allow condensate to flow (weep) into the second reservoir. Accordingly, in embodiments, the at least one condensate reservoir of the dry surface radiative cooling device's condensate manager may include at least one weep hole through which condensate may be transferred to a second condensate reservoir. The at least one weep hole may comprise a plurality of weep holes. One or more weep hole may be disposed between each of a plurality of intake restrictors. For example, as illustrated in FIG. 1H, the condensate manager includes condensate collection reservoir 104 that has at least one weep hole 106 disposed between each of a plurality of intake restrictors 134.

Alternatively, the condensate manager may further comprise a condensate transfer device. The condensate transfer device may be a gravity driven transfer device or a pump driven transfer device. The condensate transfer device may include a collection chamber to accept excess collected condensate. To transfer condensate from one location to another, the condensate transfer device may include a conduit to serve as a drain and/or may include a pump to pump condensate from the condensate collection reservoir through a hose to a spray nozzle in or near, including adjacent to, the condensing unit, and/or to an atomizer in the condensing unit, or to a bucket, the drain and the like. In an embodiment, the conduit may comprise a hose. The hose may be arranged such that condensate that accumulates within the housing is transported to a location external to the housing, for example, to a bucket located external to the housing of the dry surface radiative cooling device. In an embodiment, a bucket may be located inside the housing and the hose may be configured such that collected condensate is transported to the bucket for later removal and emptying thereof.

As discussed above, condensate may be transported from a collection reservoir to another area. For example, the condensate may be further transported from the collection reservoir to an area where it may contact air traveling through the second air flow path, and where it may be removed via evaporation. For example, the condensate may be transported from the collection reservoir to an evaporation reservoir. Accordingly, in an embodiment, the dry surface radiative cooling device may include an evaporation reservoir. To assist with removal of condensate via evaporation, the evaporation reservoir may include a heat source such as an electrical heater to accelerate the evaporation rate.

The condensate collection reservoir may include a waterproof material so that condensate may only exit through the at least one weep hole. For example, the condensate collection tray may comprise plastic, metal, or a combination thereof.

The condensate manager may further include an ultrasonic atomizer. In order to increase the exposed surface area of the collected condensate and increase evaporation thereof, the ultrasonic atomizer may operate to form droplets of condensate (i.e., atomize the condensate). Atomized condensate may be further transported to be in contact in the hot-side air stream, such as air traveling through the second air flow and exits at the at least one heat rejection outlet.

In an example, the condensate manager may be configured to transport condensate from within the housing to a location external to the housing. In such a case, there may be a condensate conduit (tube) that extends from a location near the first heat exchanger where condensate is to be collected to an externally located second heat exchanger. In this way, condensate may be transported to the second heat exchanger and may be atomized by air flowing through a hot-side air flow path thereof.

The dry surface radiative cooling device may further include control logic, such as software that is stored in a memory device and executed by a processor. The software may comprise control logic for operating various aspects of the dry surface radiative cooling device such as the at least one fan and/or the refrigerant circuit, as well as any sensors that may further be included with the dry surface radiative cooling device such as for sensing humidity, temperature and/or condensate volume. For example, the dry surface radiative cooling device may further include a water level sensor. The water level sensor may be placed in and/or adjacent to the condensate tray and may be used for activating and de-activating the atomizer or any other condensate management system including the aforementioned. Advantageously, a water level sensor can also be used for determining whether weep holes in a condensate tray have been clogged by sensing condensate accumulation where condensate should not be accumulating.

Figure 1L:
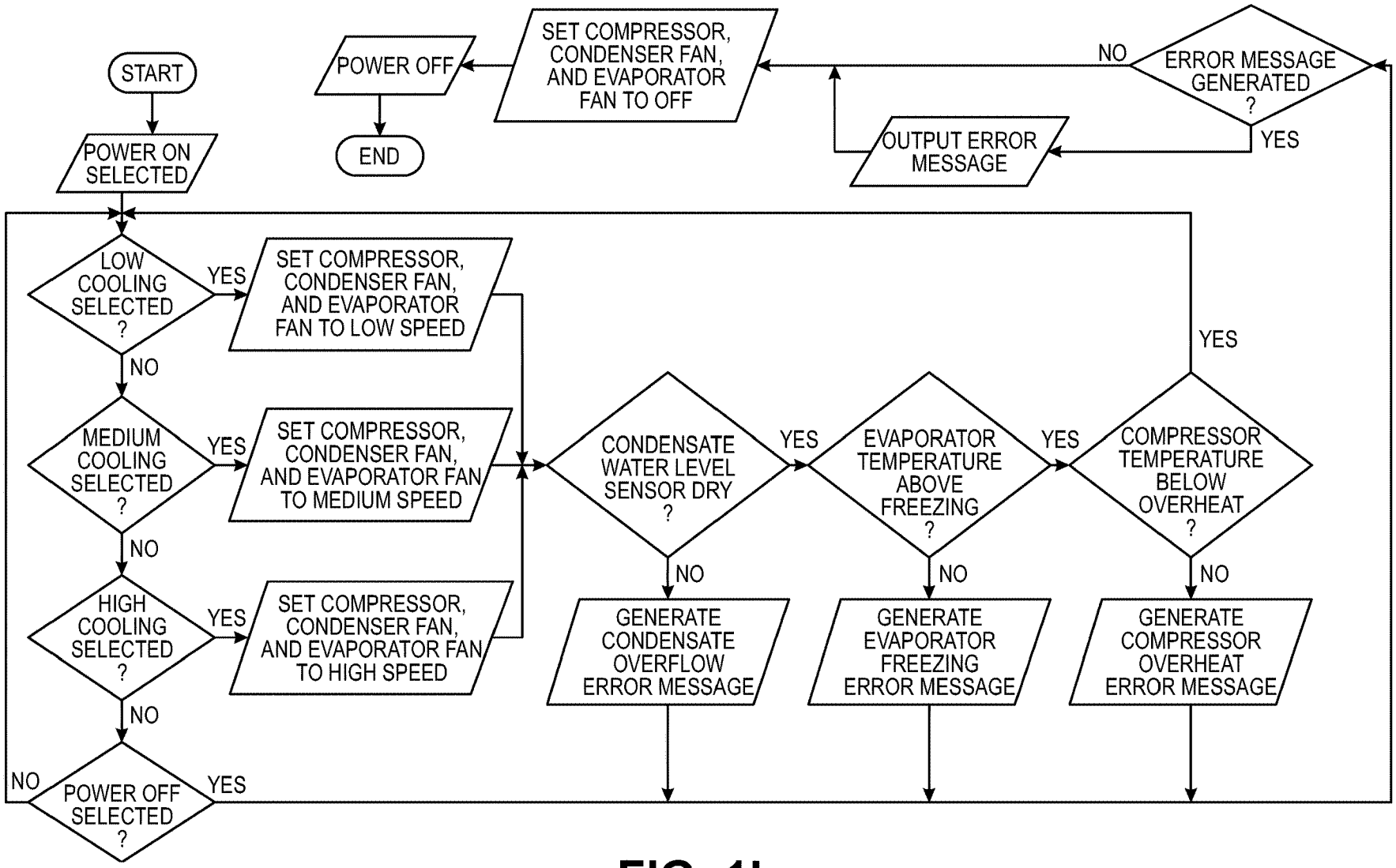
FIG. 1L is a flow chart of the control logic software to operate the embodiment shown in FIGS. 1A-1K.

For example, as illustrated in FIG. 1L, the dry surface radiative cooling device may be operated via software based on control logic flowchart 1000. Without being limited to any particular hardware-software combination, a controller (e.g., PID, on/off, etc.) may communicate with at least one sensor that senses evaporator temperature, air discharge temperature, etc., and can cause various features such as compressor speed/fan speeds to match a user selected set point temperature.

An example of one control logic is provided in FIG. 1L. After the device is powered on, the user may input a low, medium, or high cooling level. The control logic may then cause a controller to vary the compressor speed, condenser fan speed, and the evaporator fan speed to accommodate the user-selected cooling level. A series of failsafe checks may then be executed to ensure the device is properly operating. For example, the control logic may continuously monitor whether the condensate water level sensor is dry, the evaporator temperature is above freezing, and/or the compressor temperature is below overheat. If any of these failsafe checks do not pass a predetermined precondition, an output error message may be generated and displayed, and the compressor, condenser fan, and/or evaporator fan may be powered off.

Figure 2:
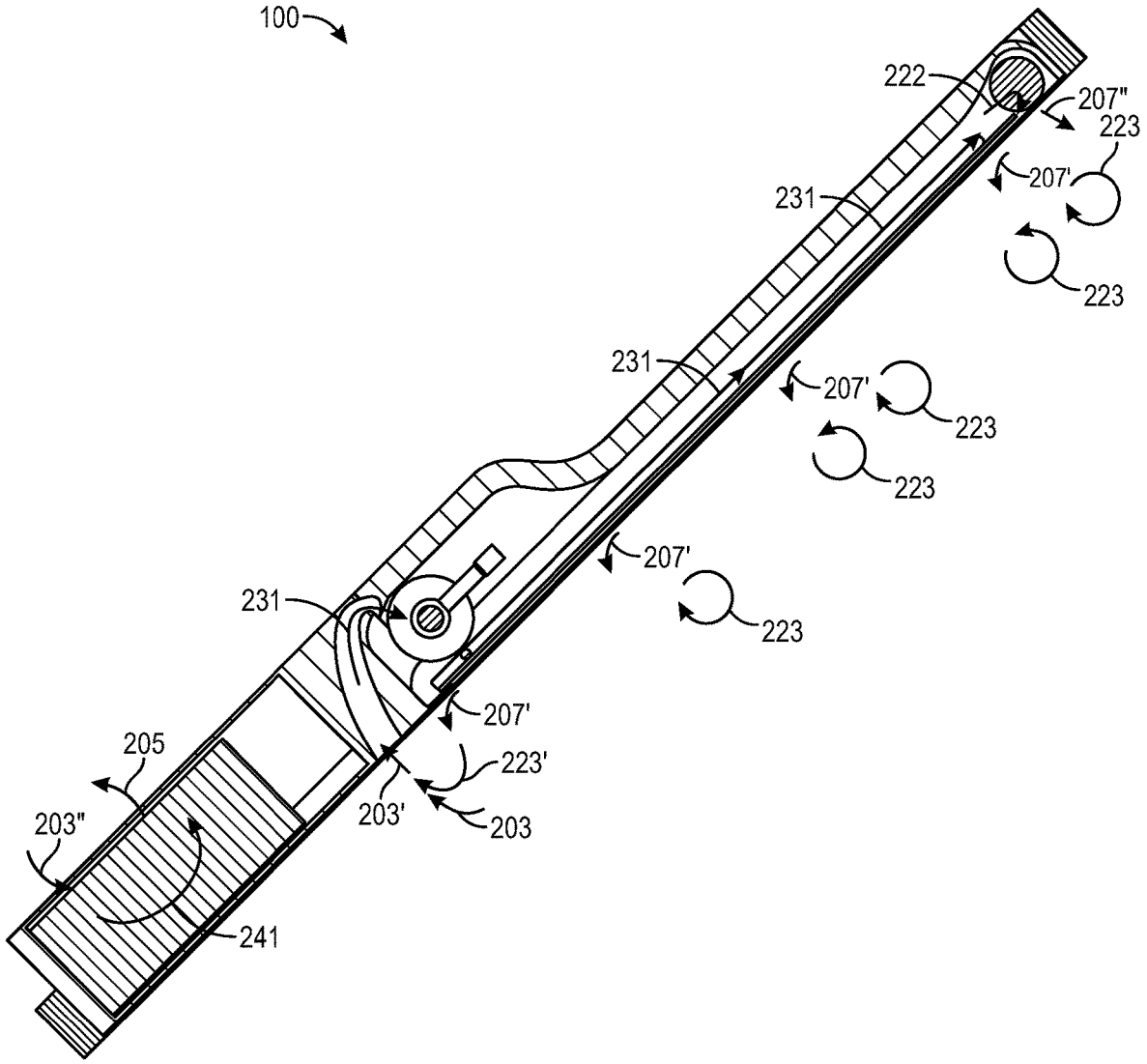
FIG. 2 is a simplified cross-sectional view of a dry surface radiative cooling device of an embodiment with superimposed exemplary airflows.

FIG. 2 illustrates the dry surface radiative cooling device 100 during operation with air flow (represented by solid arrows) superimposed over the device 100 as introduced in FIG. 1A (with labels from FIG. 1A omitted). Ambient air 203 and/or recirculated air 223' enters the dry surface radiative cooling device through the first ambient air inlet as a combined air stream 203'. As indicated by arrows 231, the air that entered the first ambient air inlet then travels through the first air flow path. As the air flow indicated by arrow 231 continues through the dry surface radiative cooling device, it passes a volume adjacent to a back side of the first heat exchanger, such as the cold plate evaporator described above. There, the temperature and absolute humidity of the air is lowered due to heat exchange with the first heat exchanger.

As previously described, the at least one cooled air outlet may comprise a first cooled air outlet and a second cooled air outlet. Without being limited to any configuration or design, a partial volume of the air traveling through the first air flow path may exit through an optional second cooled air outlet and may, therefore, provide convective cooling to an area adjacent the dry surface radiative cooling device. For example, as indicated by arrow 207" after initially contacting the first heat exchanger, a partial volume of the air may be (optionally) directed to exit the dry surface radiative cooling device 100.

A portion of the volume of the air continues through a remaining portion of the first air flow path where it may contact additional surface area of the first heat exchanger such as a front surface thereof facing the permeable member. For example, a volume of the air as represented by arrow 222 is directed to the gap between the first heat exchanger (e.g., cold plate evaporator) and the permeable member. As the air flows within the gap, it continues to exchange heat with the first heat exchanger (e.g., cold plate evaporator) and the temperature and/or absolute humidity thereof may continue to decrease prior to being discharged through the first cooled air outlet and through the permeable member's permeable surface as a cooled air stream. The cooled air stream may comprise a dry (i.e., low dew point) air cushion adjacent to the permeable surface. The dry air cushion may provide an air barrier to prevent the penetration of higher dew point ambient air to the permeable member's permeable surface. Without the air cushion, the higher dew point ambient air could contact the permeable member in high enough volume so as to cause the formation of unwanted condensate on the permeable member surface. Accordingly, the air may be transported through the first air flow path at a volume and velocity to prevent or, at the very least, minimize condensate formation on the surface of the permeable member. For example, the air flowing through the gap is discharged through the permeable member, such as through openings of the permeable surface as cooled air stream 207' to form the dry air cushion 223 adjacent to the permeable surface.

In an embodiment, at least a fraction of the low temperature/low absolute humidity conditioned air may be recirculated back into the ambient air inlet. For example, some of the air that is discharged through openings of the permeable surface 123 and returns back into the first airflow path via the first ambient air inlet as recirculated air 223' to be placed back in thermal and/or physical communication with the first heat exchanger. Accordingly, the first ambient air inlet of the dry surface radiative cooling device may be configured to accept, substantially in real-time, at least a fraction of conditioned air that exits the at least one cooled air outlet that may be partially mixed with ambient air. While not limited to any particular theory, it is believed that via the recirculation (i.e., intake of lower enthalpy, conditioned air) reduces the amount of work required by the compressor because the amount of heat that the first heat exchanger removes from the combined stream of recirculated and ambient air is reduced relative to a stream comprising only ambient air having higher enthalpy.

The dry surface radiative cooling device may comprise a second air flow path extending between the at least one ambient air inlet and the at least one heat rejection outlet. The second air flow path may be disposed at least partially within the housing, extending between a second ambient air inlet and the at least one heat rejection outlet. For example, a second portion of ambient air may enter the dry surface radiative cooling device 100 through a condensing unit air inlet 203", travel through the second air flow path 241 where heat exchange with the second heat exchanger (e.g., condensing unit) occurs, and exits as condensing unit air discharge 205 serving as at least one heat rejection outlet.

Optionally, the second heat exchanger may be disposed outside of the housing. Where the second heat exchanger is disposed outside of the housing, the second air flow path is not disposed at least partially within the housing in which the first air flow path is at least partially disposed.

Figure 3A:
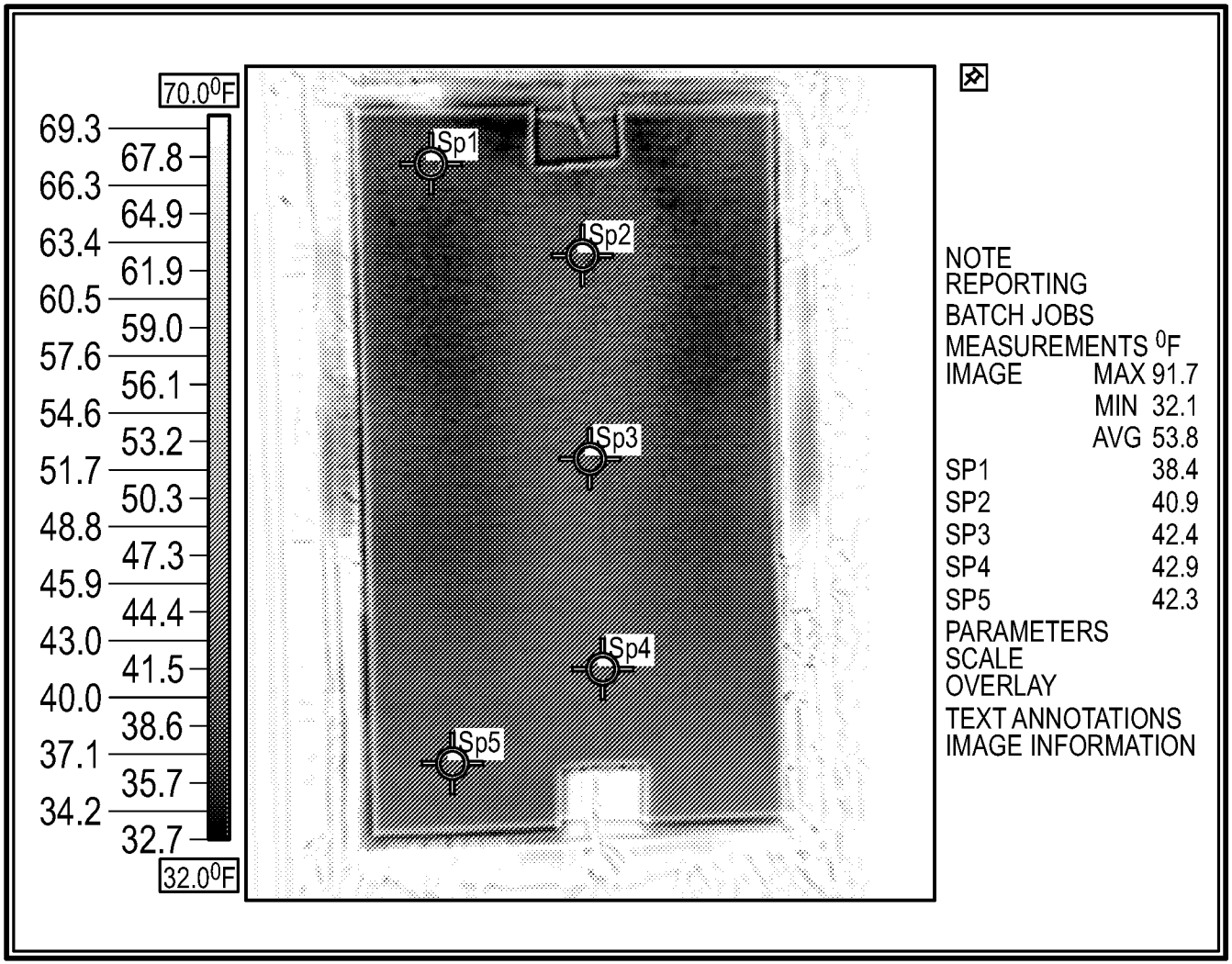
FIGS. 3A-3C are infrared images of exemplary dry surface radiative cooling devices during operation.
Figure 3B:
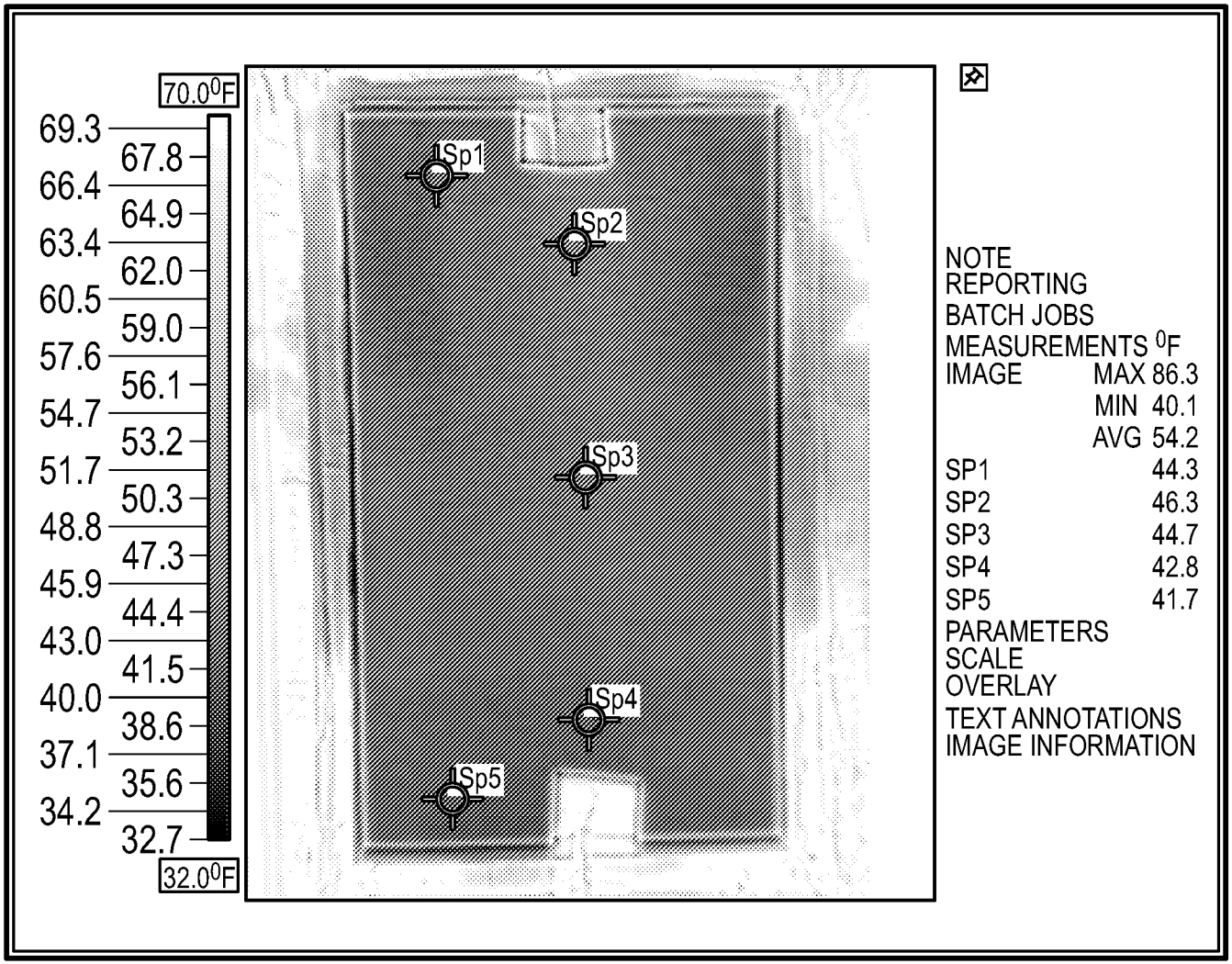
Figure 3C:
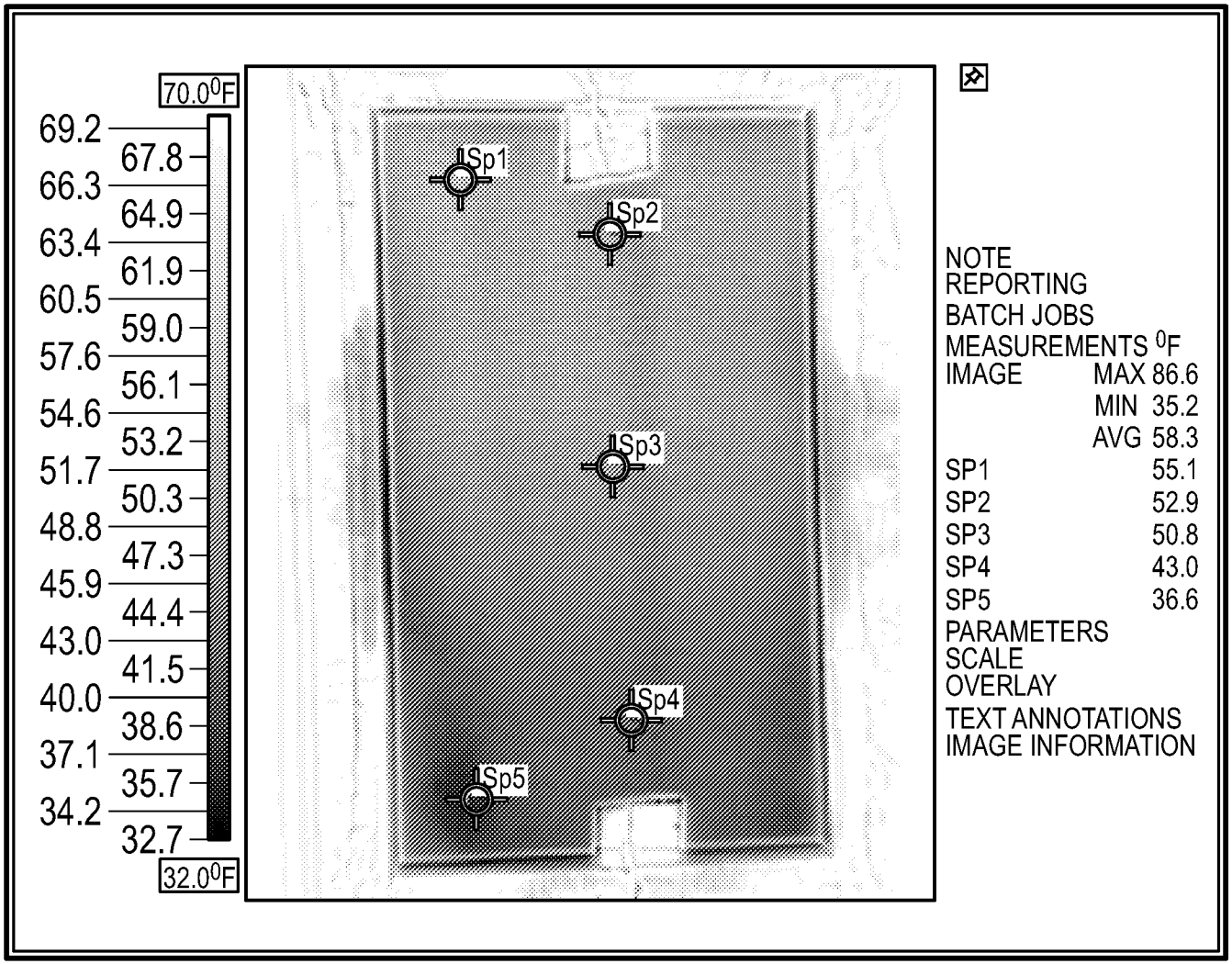

FIGS. 3A-3C are infrared thermal images showing a front portion of dry surface radiative cooling devices, as contemplated herein, during their respective operation. Each dry surface radiative cooling device in FIGS. 3A-3C is similar in design except that the gap distance between the cold plate evaporator and the permeable member (here, a mesh screen), is different. For the dry surface radiative cooling device shown in FIG. 3A, the gap distance was 3/16". For the dry surface radiative cooling device shown in FIG. 3B, the gap distance was 5/16". For the dry surface radiative cooling device shown in FIG. 3C, the gap distance was 5/8". For the operation of each device, the following inputs were substantially fixed: compressor speed, evaporator air volumetric flow rate, condenser air volumetric flow rate, mesh screen type, back airflow path design and evaporator plate temperature. As shown across FIGS. 3A-3C, infrared signal changed in magnitude as the gap distance changed. As shown in the figures, measured infrared temperature decreased as the gap distance decreased.

Figure 4A:
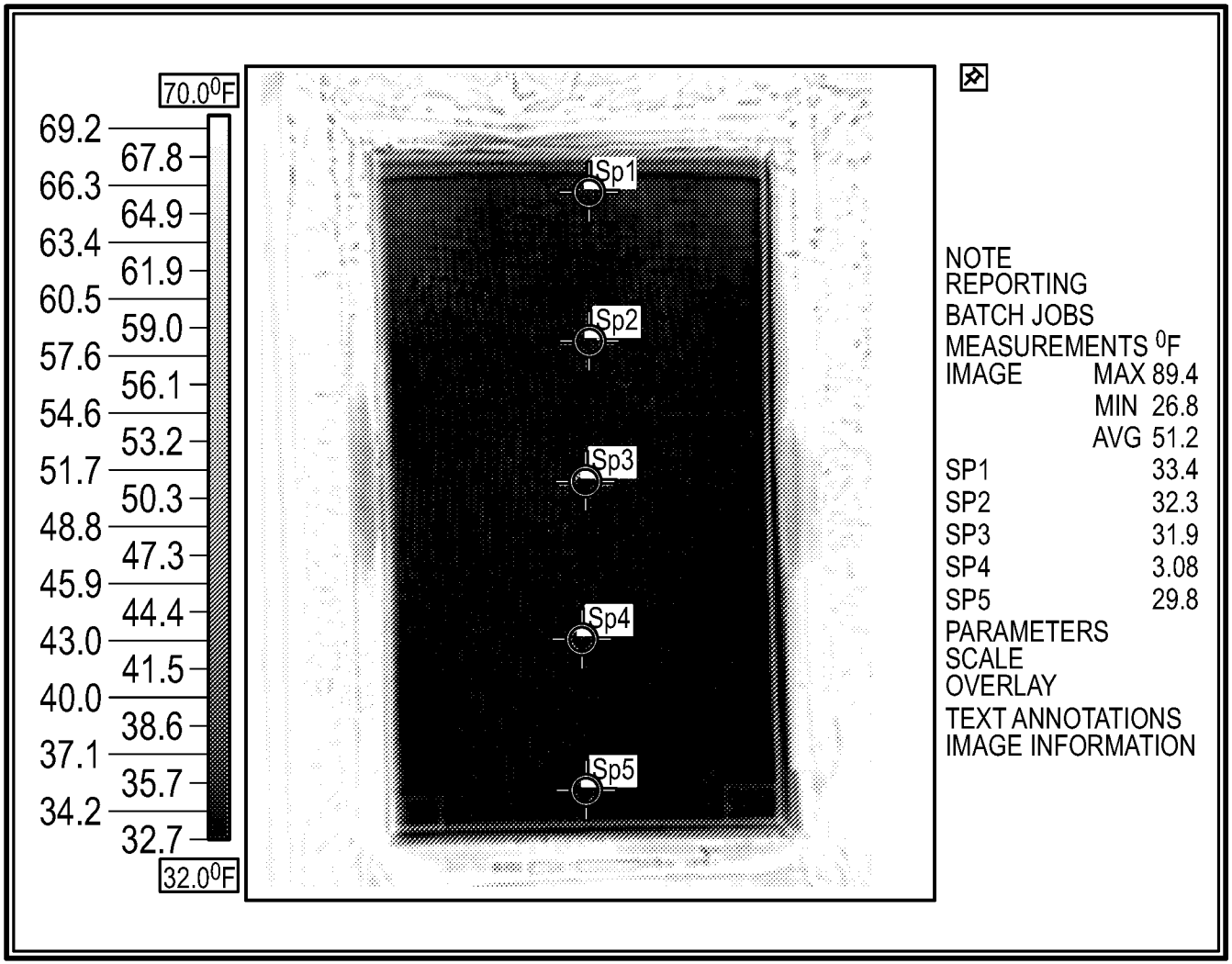
FIGS. 4A-4C are infrared images of exemplary dry surface radiative cooling devices during operation.
Figure 4B:
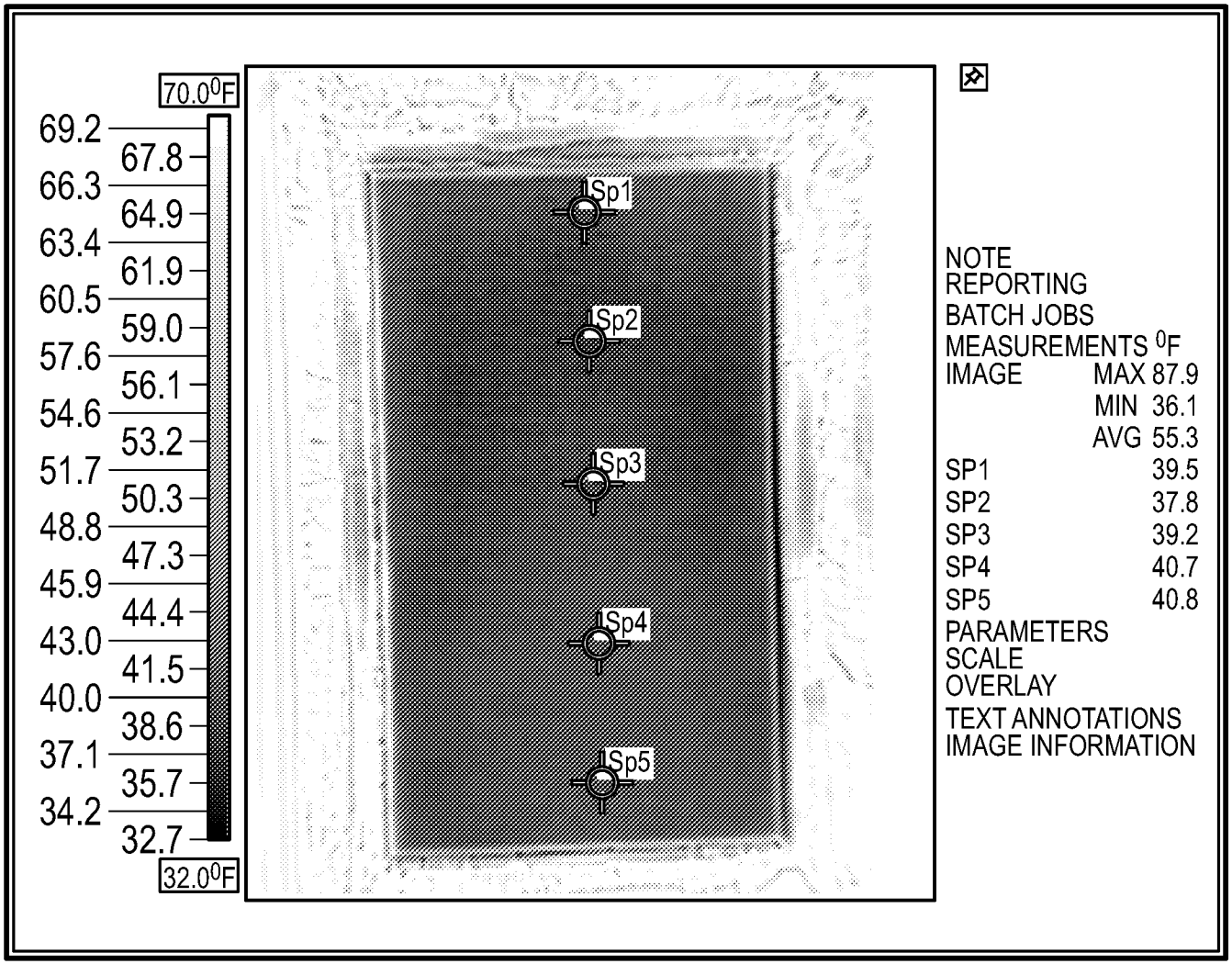
Figure 4C:
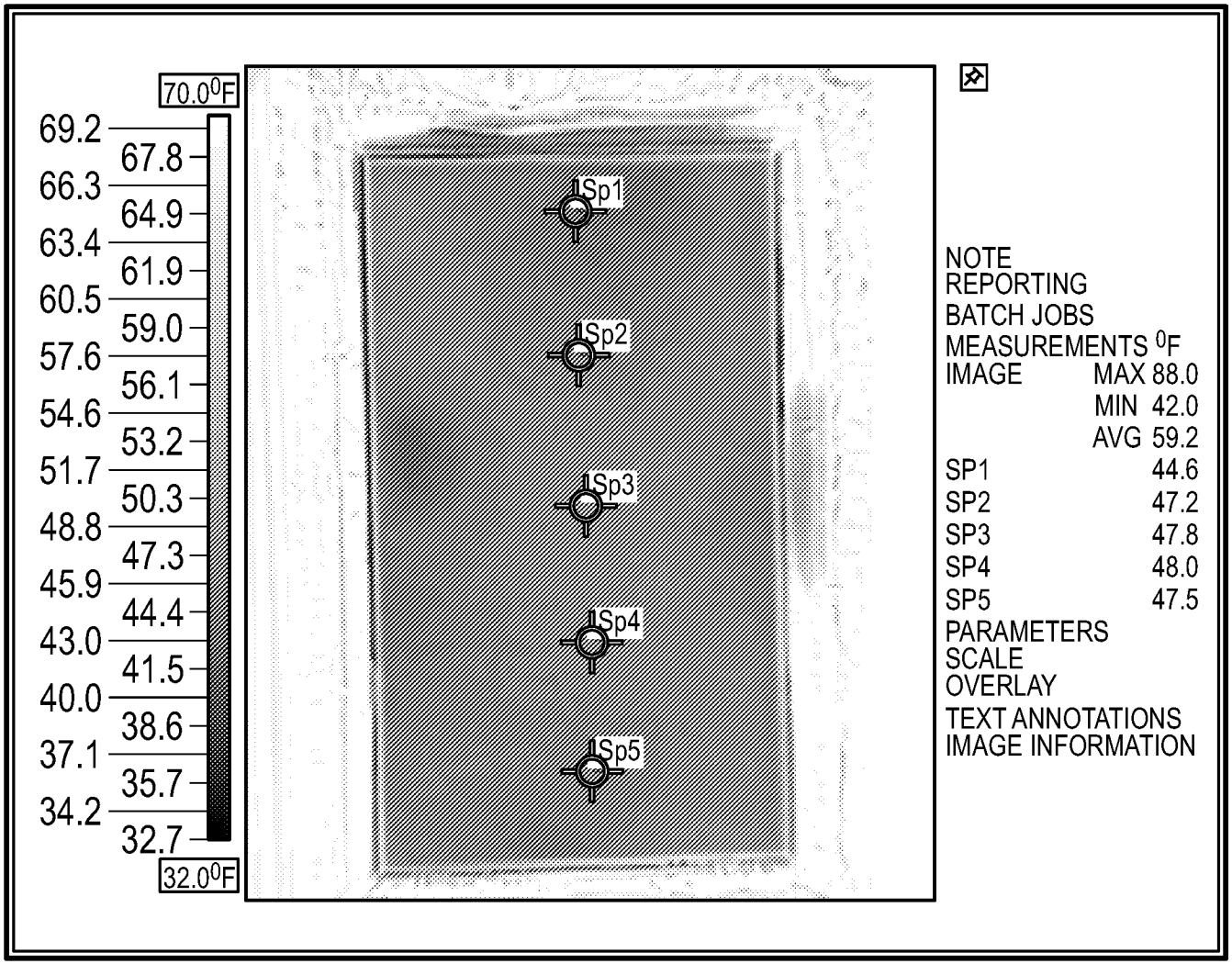

FIGS. 4A-4C are infrared thermal images showing a front portion of dry surface radiative cooling devices, as contemplated herein, during their respective operation. Each dry surface radiative cooling device in FIGS. 4A-4C is similar in design except that the mesh density of the permeable member (here, a mesh screen), is different. For the dry surface radiative cooling device shown in FIG. 4A, the mesh density was very coarse. For the dry surface radiative cooling device shown in FIG. 4B, the mesh density was medium fineness. For the dry surface radiative cooling device shown in FIG. 4C, the mesh density was very fine. For the operation of each device, the following inputs were substantially fixed: compressor speed, evaporator air volumetric flow rate, condenser air volumetric flow rate, gap distance between permeable member and cold plate, back air flow path design (i.e., the portion of the housing that would accommodate the first air flow path), and evaporator plate temperature. As shown across FIGS. 4A-4C, infrared signal changed in magnitude as the mesh screen type changed indicating that measured infrared temperature decreased as the mesh fineness decreased.

Figure 5:
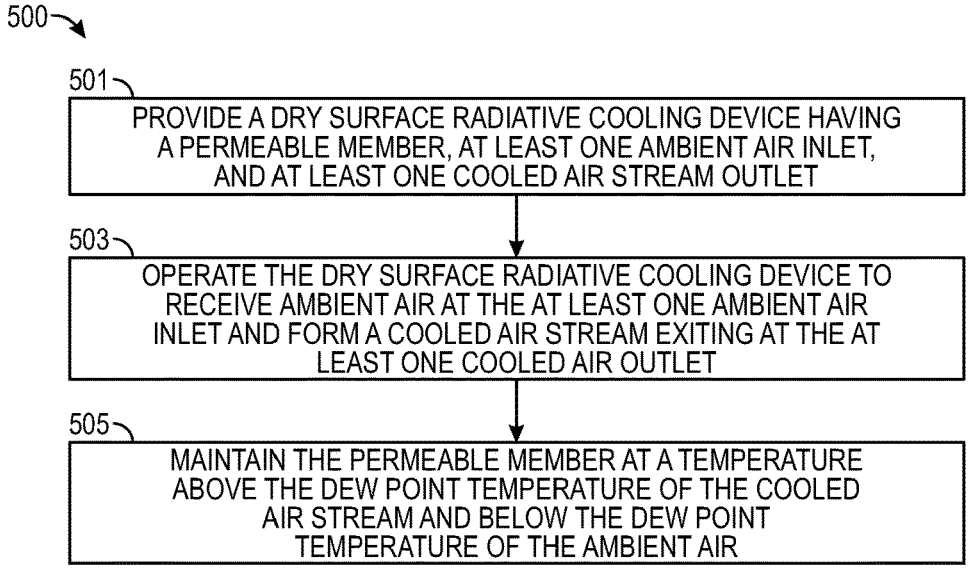
FIG. 5 is a flow-chart describing a method for providing spot cooling.

A method 500 for providing spot-cooling is illustrated in FIG. 5 as a flow chart. In the method, a dry surface radiative cooling device having a permeable member and at least one cooled air outlet is provided 501. The dry surface radiative cooling device is operated 503 to receive ambient air at the at least one ambient air inlet and form a cooled air stream exiting at the at least one cooled air outlet. The permeable member is maintained 505 at a temperature above the dew point temperature of the cooled air stream and below the dew point temperature of the ambient air. The dry surface radiative cooling device contemplated in method 500 may be selected from the embodiments as described above.

Figure 6:
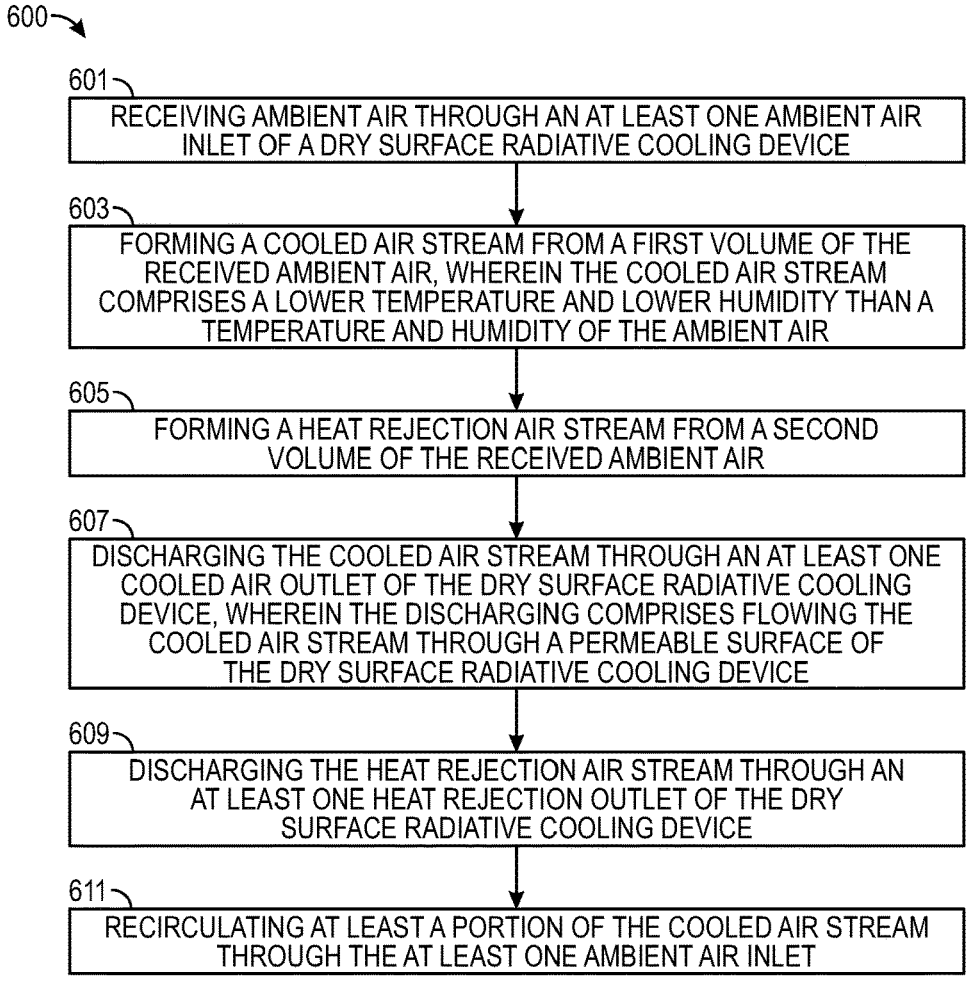
FIG. 6 is a flow-chart describing a method for providing spot cooling.

A method 600 for providing spot-cooling is illustrated in FIG. 6 as a flow chart. The method 600 includes the steps of receiving 601 ambient air through an at least one ambient air stream inlet of a dry surface radiative cooling device; forming 603 a cooled air stream from a first volume of the received ambient air, wherein the cooled air stream comprises a lower temperature and lower humidity than a temperature and humidity of the ambient air; forming 605 a heat rejection air stream from a second volume of the ambient air; discharging 607 the cooled air stream through an at least one cooled air outlet of the dry surface radiative cooling device, wherein the discharging comprises flowing the cooled air stream through a permeable surface of the dry surface radiative cooling device; and discharging 609 the heat rejection air stream through an at least one heat rejection outlet of the dry surface radiative cooling device. In the method 600, the forming 603 the cooled air stream may include flowing the first volume of the ambient air through a first air stream path that extends between the at least one ambient air stream inlet and the permeable surface through at least one cooled air outlet, and is at least partially defined by a gap between a surface of a first heat exchanger of the dry surface radiative cooling device and the permeable member, wherein a temperature of the first heat exchanger is lower than the dew point temperature of the first volume of the ambient air. In the method 600, the forming 605 of the heat rejection air stream may include flowing the second volume of the ambient air through a second air flow path that extends between the at least one ambient air inlet and the at least one heat rejection outlet. In the method, a temperature of the permeable member is maintained to be higher than a temperature of the surface of the first heat exchanger and lower than the ambient dew point temperature. As further illustrated in FIG. 6, the method 600 may further include recirculating 611 at least a portion of the cooled air stream through the at least one ambient air inlet 611.

Figure 7B:
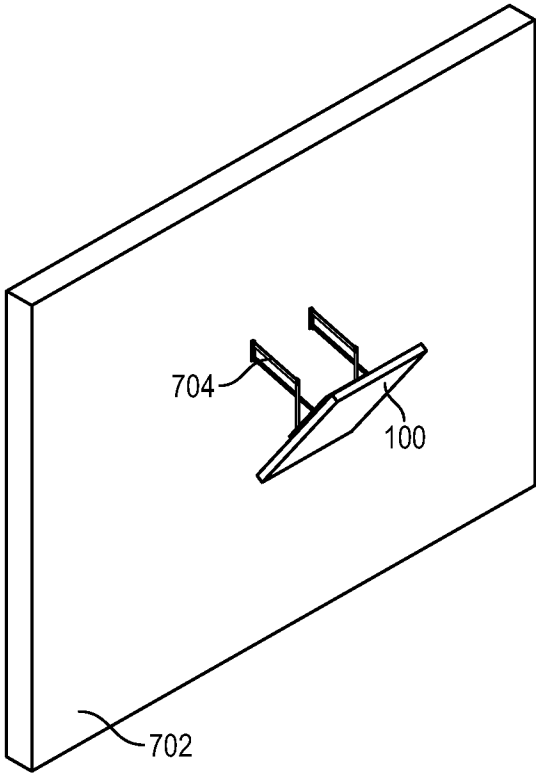
FIGS. 7A-7B are schematic representations illustrating a dry surface radiative cooling device of an embodiment mounted to a wall.
Figure 7A:
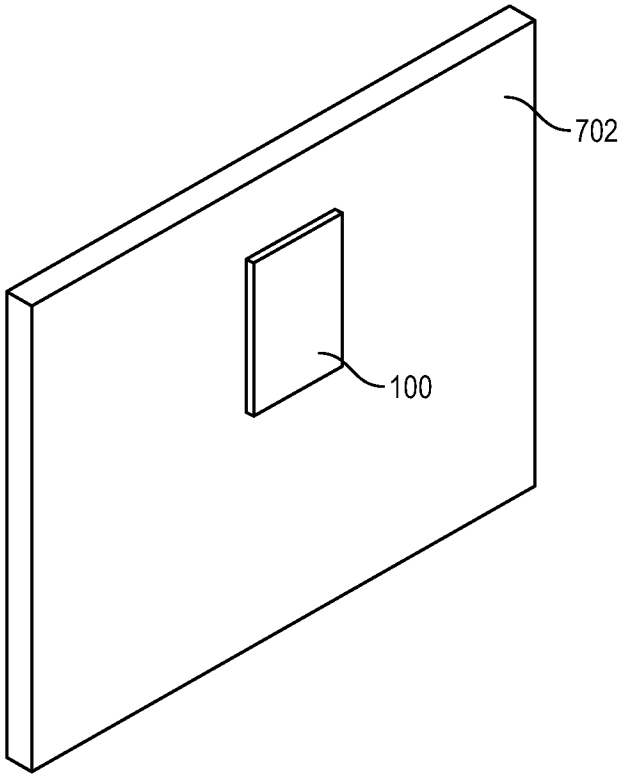

The dry surface radiative cooling device of the embodiments may be self-supported, or affixed to or detachably mounted to the floor, for example, via a floor mount or floor stand, or may be secured, affixed, or detachably mounted to a wall or other object, for example, via a mount that may be an adjustable mount. For example, as shown in FIGS. 7A-7B., dry surface radiative cooling device 100 is mounted to a wall 702 via mount 704. As shown in FIGS. 7A-7B the dry surface radiative cooling device 100 of the embodiments may extend away from the wall 702 during use (FIG. 7B) and retract to be disposed against the wall 700 when it is not in use (FIG. 7A), though it may also operate when retracted.

Figure 8B:
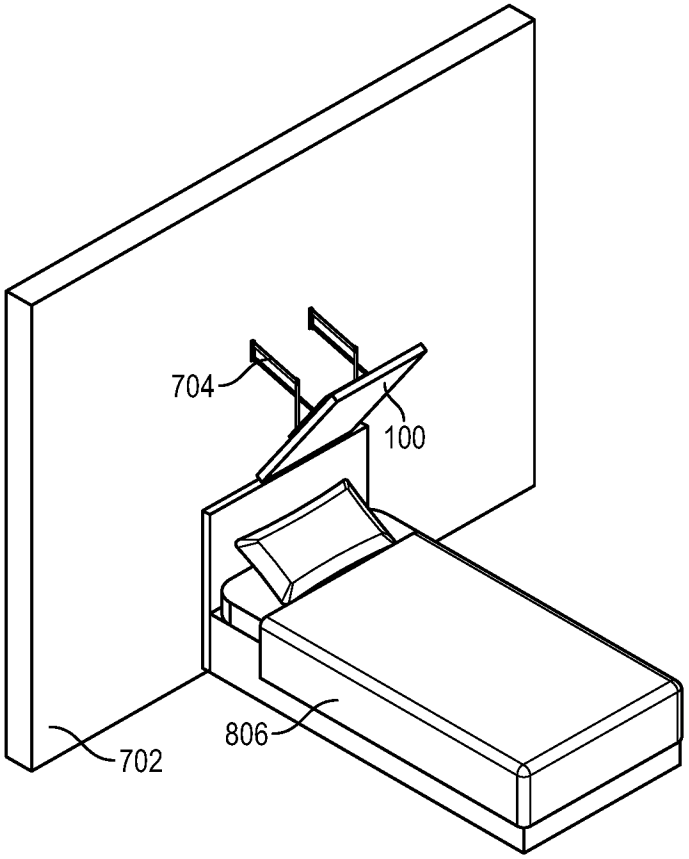
FIGS. 8A-8B are schematic representations of a spot cooling application that includes a dry surface radiative cooling device of an embodiment operating in proximity to an object such as a bed.
Figure 8A:
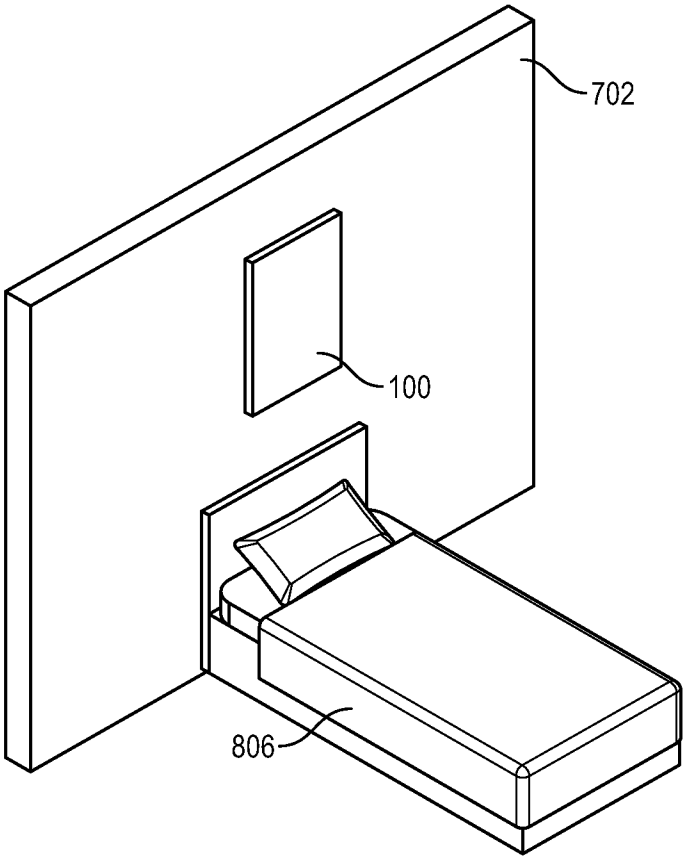

The dry surface radiative cooling device of the embodiments may be a stand-alone device or may be incorporated with, or affixed to or detachably mounted to other items, such as furniture (e.g., a headboard, a bed, a couch, a table, a desk, and the like). For example, as illustrated in FIGS. 8A-8B, a spot cooling application of a dry surface radiative cooling device of the embodiments includes placement and operated of the dry surface radiative cooling device 700 as a stand-alone device in proximity to furniture 806 (e.g., a headboard, bed, a couch, a table, a desk, and the like) such as mounted to wall 702 via mount 704. As shown in FIGS. 8A-8B, the dry surface radiative cooling device 700 of the embodiments may extend away from the wall and over furniture 806 during use (FIG. 8B) and retract to be disposed against the wall 702 when it is not in use (FIG. 8A), though it may also operate when retracted.

Figure 9:
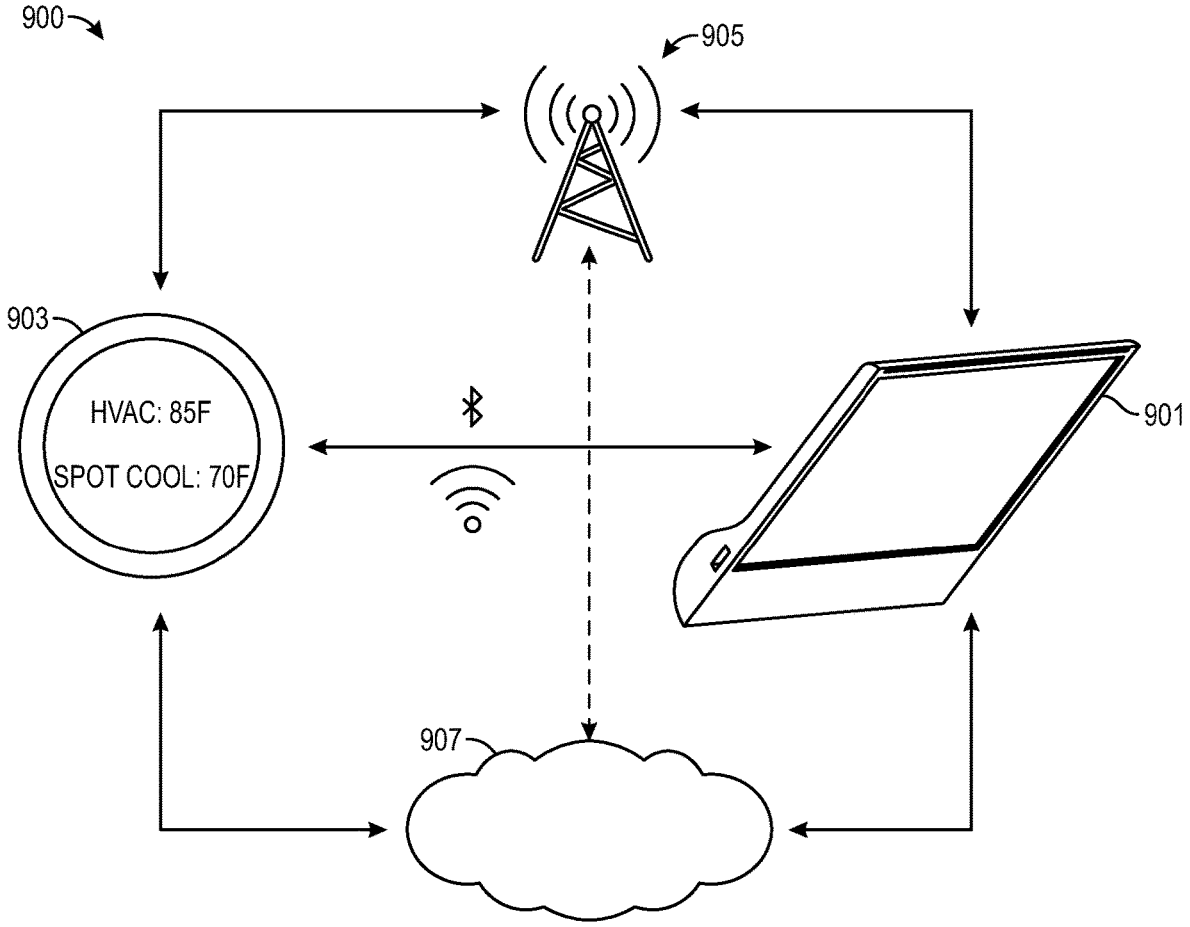
FIG. 9 is a schematic representation of a spot cooling system.

The dry surface radiative cooling device of the embodiments may be incorporated in a connected system, such as a smart thermostat. For example, as illustrated in FIG. 9, a spot cooling system 900 is shown. The spot cooling system 900 includes a dry surface radiative cooling device 901 that may be wired or wirelessly connected (e.g., WI-FI™ or BLUETOOTH®) to a household or commercial grade thermostat such as a smart thermostat 903. The dry surface radiative cooling device 901 and the thermostat 903 may be in communication via a cellular connection 905 or via an internet service provider (ISP) to a cloud-based application 907. A user seeking spot cooling to set customized temperature and other settings either directly at the dry surface radiative cooling device 901, at the thermostat 903 or via a user interface (not shown) connected to the cloud-based application 907. Such control may also be accessed remotely on a smartphone, computer, tablet or other interface device that provides a connection to the cloud-based application and control of the HVAC and or spot cooling settings.

While the present teachings have been illustrated with respect to one or more implementations, alterations and/or modifications may be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages may be added or existing structural components and/or processing stages may be removed or modified. Further, one or more of the acts depicted herein may be carried out in one or more separate acts and/or phases.

Furthermore, to the extent that the terms "including," "includes," "having," "has," "with," or variants thereof are used in either the detailed description or the claims, such terms are intended to be inclusive in a manner similar to the term "comprising." The term "at least one of" is used to mean one or more of the listed items may be selected. As used herein, the phrase "one or more of", for example, A, B, and C means any of the following: either A, B, or C alone; or combinations of two, such as A and B, B and C, and A and C; or combinations of three A, B and C. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dry surface radiative cooling device, comprising:

at least one ambient air inlet;

a housing;

a permeable member comprising a screen mesh defining a cooled air outlet through which cooled and dehumidified air exits the housing;

a plate-type heat exchanger comprising a planar back cooled surface and a planar front cooled surface facing the permeable member and separated from the permeable member by a gap;

a first air flow path disposed within the housing, extending from the at least one ambient air inlet, across the planar back cooled surface, through the gap between the planar front cooled surface of the plate-type heat exchanger and the permeable member, and out through the screen mesh; and a fan disposed within the housing downstream in the first air flow path from the planar back cooled surface and upstream in the first air flow path from the planar front cooled surface;

wherein the planar front cooled surface of the plate-type heat exchanger is adapted to have a radiative heat transfer line of sight, extending through the permeable member, with surroundings external to the housing, and wherein the permeable member is oriented to have a radiative heat transfer line of sight with the surroundings.

2. The dry surface radiative cooling device of claim 1, further comprising a secondary cooled air outlet upstream of the cooled air outlet in the first air flow path, configured such that a partial volume of air traveling through the first air flow path can exit through the secondary cooled air outlet.

3. The dry surface radiative cooling device of claim 1, wherein the permeable member is detachably connected to the housing.

4. The dry surface radiative cooling device of claim 1, further comprising:

a vapor compression refrigerant circuit disposed at least partially within the housing, and wherein the vapor compression refrigerant circuit comprises the heat exchanger;

a refrigerant conduit for transporting a refrigerant and that connects to the heat exchanger;

at least one second heat exchanger for releasing heat from the refrigerant;

at least one heat rejection outlet; and at least one refrigerant compressor.

5. The dry surface radiative cooling device of claim 4, wherein the screen mesh comprises a plurality of holes defining the cooled air outlet, and wherein the screen mesh is configured to restrict airflow such that air exiting at the cooled air outlet forms a dry air cushion adjacent to the screen mesh.

6. The dry surface radiative cooling device of claim 4, wherein the planar front cooled surface is configured to cool ambient air entering the at least one ambient air inlet to a temperature below a dew point of the ambient air.

7. The dry surface radiative cooling device of claim 4, wherein the screen mesh comprises a plurality of holes defining the cooled air outlet, wherein the screen mesh is configured to restrict airflow such that air exiting at the cooled air outlet forms a dry air cushion adjacent to the screen mesh, and wherein the planar front cooled surface is configured to cool ambient air entering the at least one ambient air inlet to a temperature below a dew point of the ambient air.

8. The dry surface radiative cooling device of claim 4, wherein the gap comprises a gap distance of from about ⅛" to about 1".

9. The dry surface radiative cooling device of claim 4, wherein the screen mesh comprises a plurality of holes defining the cooled air outlet, wherein the screen mesh is configured to restrict airflow such that air exiting at the cooled air outlet forms a dry air cushion adjacent to the screen mesh, and wherein the gap comprises a gap distance of from about ⅛" to about 1".

10. The dry surface radiative cooling device of claim 4, wherein the at least one ambient air inlet is configured to return and recycle, to the planar back cooled surface, a portion of the cooled and dehumidified air discharged from the first air flow path.

11. The dry surface radiative cooling device of claim 10, wherein the screen mesh comprises a plurality of holes defining the cooled air outlet, wherein the screen mesh is configured to restrict airflow such that air exiting at the cooled air outlet forms a dry air cushion adjacent to the screen mesh, wherein the planar front cooled surface is configured to cool ambient air entering the at least one ambient air inlet to a temperature below a dew point of the ambient air, and wherein the permeable member is at least partially transparent to thermal radiation transmitted between the planar front cooled surface and the surroundings external to the housing.

12. The dry surface radiative cooling device of claim 11, wherein the fan comprises a variable speed fan, and further comprising:

at least one intake restrictor disposed at an end portion of the gap, wherein the intake restrictor is disposed between the heat exchanger and the permeable member, and wherein the at least one intake restrictor is configured to separate higher pressure air discharged by the fan from a lower pressure air being pulled into the device through the first air flow path.

13. The dry surface radiative cooling device of claim 1, wherein the screen mesh comprises a plurality of holes defining the cooled air outlet, and wherein the screen mesh is configured to restrict airflow such that air exiting at the cooled air outlet forms a dry air cushion adjacent to the screen mesh.

14. The dry surface radiative cooling device of claim 1, wherein the gap comprises a gap distance of from about ⅛" to about 1".

15. The dry surface radiative cooling device of claim 1, wherein the planar front cooled surface comprises a treated surface having high emissivity relative to non-treated surface portions of the device.

16. The dry surface radiative cooling device of claim 1, wherein the screen mesh comprises a plurality of holes defining the cooled air outlet, wherein the screen mesh is configured to restrict airflow such that air exiting at the cooled air outlet forms a dry air cushion adjacent to the screen mesh, and wherein the heat exchanger is configured to cool received ambient air entering the air flow path through the at least one ambient air inlet to a temperature lower than a dew point of the ambient air.

17. The dry surface radiative cooling device of claim 1, wherein the at least one ambient air inlet is configured to return and recycle, to the planar back cooled surface, a portion of the cooled and dehumidified air discharged from the first air flow path.

18. The dry surface radiative cooling device of claim 17, wherein the screen mesh comprises a plurality of holes defining the cooled air outlet, wherein the screen mesh is configured to restrict airflow such that air exiting at the cooled air outlet forms a dry air cushion adjacent to the screen mesh, and wherein the heat exchanger is configured to cool received ambient air entering the air flow path through the at least one ambient air inlet to a temperature lower than a dew point of the ambient air.

19. The dry surface radiative cooling device of claim 18, wherein the fan comprises a variable speed fan, and further comprising:

at least one intake restrictor disposed at an end portion of the gap, wherein the intake restrictor is disposed between the heat exchanger and the permeable member, and wherein the at least one intake restrictor is configured to separate higher pressure air discharged by the fan from a lower pressure air being pulled into the device through the first air flow path.

20. The dry surface radiative cooling device of claim 1, wherein the permeable member is at least partially transparent to thermal radiation transmitted between the planar front cooled surface and the surroundings external to the housing.

21. The dry surface radiative cooling device of claim 1, further comprising at least one intake restrictor disposed at an end portion of the gap, and secured by an inner wall portion of the housing, wherein the intake restrictor is disposed between the heat exchanger and the permeable member.

22. A method for providing spot cooling, comprising:

providing a dry surface radiative cooling device comprising:

at least one ambient air inlet;

a housing;

a permeable member comprising a screen mesh defining a cooled air outlet through which cooled and dehumidified air exits the housing;

a plate-type heat exchanger comprising a planar back cooled surface and a planar front cooled surface facing the permeable member and separated from the permeable member by a gap;

a first air flow path disposed within the housing, extending from the at least one ambient air inlet, across the planar back cooled surface, through the gap between the planar front cooled surface of the plate-type heat exchanger and the permeable member, and out through the screen mesh; and a fan disposed within the housing downstream in the first air flow path from the planar back cooled surface and upstream in the first air flow path from the planar front cooled surface;

wherein the planar front cooled surface of the plate-type heat exchanger is adapted to have a radiative heat transfer line of sight, extending through the permeable member, with surroundings external to the housing, and wherein the permeable member is oriented to have a radiative heat transfer line of sight with the surroundings;

operating the dry surface radiative cooling device to receive ambient air at the at least one ambient air inlet and form a cooled air stream exiting at the at least one cooled air outlet; and maintaining the permeable member at a temperature above the dew point temperature of the cooled air stream and below the dew point temperature of the ambient air.

23. The method of claim 22, further comprising recirculating at least a portion of the cooled air stream through the dry surface radiative cooling device.

24. The method of claim 22, further comprising maintaining a flow rate of the cooled air stream such that a portion of the cooled air stream forms an air cushion adjacent to the permeable member, wherein the air cushion forms a barrier that prevents ambient air from contacting a surface of the permeable member.

25. The method of claim 22, further comprising preventing moisture from ambient air adjacent to the permeable member from condensing on a surface of the permeable member.

* * * * *